US005149218A

United States Patent [19]

Iwatani et al.

[11] Patent Number: 5,149,218

[45] Date of Patent: Sep. 22, 1992

[54] PRINTING APPARATUS WITH DISENGAGEABLE PAPER SUPPLY AND TWO-STAGE DISCHARGE PLATE

[75] Inventors: Mitsuo Iwatani; Hitoshi Kamoda; Masatoshi Mikuriya, all of Kanagawa; Tadao Kashiyama, Chiba; Yoshio Kajino, Kanagawa, all of Japan

[73] Assignee: Sony Corporation, Tokyo, Japan

[21] Appl. No.: 697,897

[22] Filed: May 8, 1991

Related U.S. Application Data

[63] Continuation of Ser. No. 318,321, Mar. 3, 1989, Pat. No. 5,061,099.

[30] Foreign Application Priority Data

Mar. 31, 1988 [JP] Japan ..... 63-078691

[51] Int. Cl.[5] ..... B41J 13/10

[52] U.S. Cl. ..... 400/625; 271/127; 271/180

[58] Field of Search ..... 400/624, 625, 629, 185, 400/187, 624, 625, 629; 271/113, 121, 126, 127, 177, 180, 181, 184, 207, 225, 271; 270/52, 53, 54, 32, 45, 58; 355/321, 322, 323, 324, 325

[56] References Cited

U.S. PATENT DOCUMENTS 4,376,585 3/1983 Fromme et al. ..... 400/185
4,416,559 11/1983 Steinhilber ..... 400/629
4,461,465 7/1984 Hartman, Jr. et al. ..... 271/22
4,717,139 1/1988 Sootome et al. ..... 271/116
4,752,786 6/1988 Inoue et al. ..... 400/185
4,810,120 3/1989 Narita ..... 400/624

FOREIGN PATENT DOCUMENTS 62-16170 1/1987 Japan ..... 400/629
264162 11/1987 Japan ..... 400/624

*Primary Examiner*—David A. Wiecking
*Attorney, Agent, or Firm*—Alvin Sinderbrand; William S. Frommer

[57] ABSTRACT

A printing apparatus for printing a paper sheet on a platen by a thermal head with a three color image includes a feeding device and a paper ejecting device. The paper feeding device includes feeding rollers, a feeding tray, a feeding lever and a two-stage discharge bay. With the paper feeding device, a receiving plate for receiving a stack of paper sheets is lifted upwardly toward the feeding rollers so as to keep the leading paper sheet in contact with the feeding rollers; at the same time, a discharged sheet is moved from the first to second discharge stage. The feeding lever is adapted for moving the receiving plate slightly downwardly so as to separate the printing paper sheet from the feeding rollers before the rear edge of the sheet passes under the feeding rollers. Shock is thereby avoided when the leading edge of the sheet passes under the roller. After printing, the printed paper sheet is ejected forwardly in the printing apparatus by the ejecting device so as to facilitating removal of the printed paper sheet therefrom.

3 Claims, 21 Drawing Sheets

PRINTING APPARATUS WITH DISENGAGEABLE PAPER SUPPLY AND TWO-STAGE DISCHARGE PLATE

This application is a continuation of application Ser. No. 07/318,321, filed Mar. 3, 1989, now U.S. Pat. No. 5,061,099.

BACKGROUND OF THE INVENTION

1. Field of the Invention

The present invention relates generally to a printing apparatus. And more specifically to a printing apparatus having an ejecting device for allowing printed paper sheets to be removed easily from the printer and paper feeding device.

2. Description of the Prior Art

Printing apparatuses in which a paper sheet is wrapped about a rotatable platen and a color image printed thereon by a thermal head through a ribbon are well known. In such printers, a paper feeding device is provided at the lower side of the printer while a paper ejecting device is provided above the printer. The paper feeding device includes a plurality of feeding rollers and a driving motor therefor. A feeding tray is disposed beneath the paper feeding device for storing a stack of printing paper sheets. Within the feeding tray, a paper receiving plate is arranged. In addition, a coil spring is disposed between the paper receiving plate and the bottom of the feeding tray. The uppermost paper sheet of the stack of paper sheets placed on the paper receiving plate is urged against the periphery of the feeding roller by the coil spring under a predetermined force. By depressing a print start-button, the feeding rollers area rotated, automatically feeding one printing paper sheet toward a printing station at which a platen, a thermal head, and an ink ribbon are provided. The paper sheet is then wrapped about the peripheral surface of the platen according to the rotation thereof. The thermal head acts on a printing surface of the paper sheet through the ink ribbon to print various image patterns on the paper sheet. After printing, the printed paper sheet is propelled toward the ejecting device through an ejecting path. The ejecting device includes a plurality of ejecting rollers which carry the printed paper sheet to a receiving tray located above the feeding tray.

The aforesaid conventional type printer however has the following disadvantages. First receiving tray is positioned relatively rearwardly in the printer, removal of the printed paper sheet fed by the ejecting device onto the receiving tray is inconvenient.

Another problem encountered in printing with the above conventional type printer is that a striped image pattern tends to occur due to shocks transmitted to the printing head or platen. These shocks occur when the trailing edge of the sheet being fed passes under the feed roller and the stack of sheets is urged upwardly against the feed roller.

OBJECTS AND SUMMARY OF THE INVENTION

Accordingly, it is an object of the present invention to provide an improved printing apparatus that eliminates the above-noted defects inherent in the prior art.

It is also an object of the present invention to provide an improved printing apparatus for facilitating easy removal of printed paper sheets ejected on a receiving tray from a printing station.

It is a further object of the present invention to provide a printing apparatus having a paper feeding device which provides stable feeding of the printing paper sheets without transmitting shocks to the printing station.

In accordance with an aspect of the present invention, a printing apparatus for printing an image on a sheet of printing medium includes a printing mechanism for printing the image on the printing medium, first retention device formed at a first ejecting position provided in the printing apparatus onto which the printing medium printed by the printing head is discharged therefrom, second retention device formed at a second ejecting position laterally displaced from the first ejecting position, and ejecting device for discharging the printed sheet from the first ejecting position toward the second ejecting position.

In accordance with another aspect of the present invention, a printing apparatus for printing an image pattern on a printing paper sheet includes a printing mechanism for printing the image pattern on the printing paper sheet, a rotatable roller for feeding one of the printing paper sheets stored within the printing apparatus to the a printing mechanism, and an engaging device, associated with the rotatable roller, for engaging a sheet of stored printing paper with the peripheral surface of the rotatable roller and for disengaging the sheet from the rotatable roller prior to the time when the printing paper sheet passes the position of the rotatable roller toward the printing mechanism.

In accordance with yet another aspect of the present invention, a printing apparatus for printing an image on a sheet of printing medium includes a printing mechanism for printing the image on the sheet of printing medium, second means for feeding a sheet of printing medium to the printing mechanism, first retention device formed at a first position defining a first ejecting position provided in the printing apparatus onto which the sheet of printing medium printed by the printing mechanism is discharged, second retention device formed at a second position defining a second ejecting position laterally displaced from the first position, and ejection system for ejecting the printed sheet from the first position toward the second position. The second retention device includes a tray for storing a stack of sheets of printing medium, a rotatable roller for transmitting the sheet of printing medium toward the printing mechanism, and an engaging device operable to shift the sheet of printing medium stored within the tray to an engaging position where the sheet of printing medium comes in contact with the circumference of the rotatable roller. The engaging device shifts the sheet of printing medium from the engaging position toward a disengaging position where the sheet of printing medium is separated from the rotatable roller just prior to when the rear edge of the sheet of printing medium fed by the roller passes the roller position toward the printing mechanism.

In accordance with yet a further aspect of the present invention, a printing apparatus includes a printing mechanism including a printing head and a platen, feeding mechanism for feeding a sheet paper to the printing mechanism, discharging mechanism for transmitting the sheet paper from the printing mechanism to a tray for discharged paper, and an arm member for pushing the sheet paper on a first step to a second step. The first step is provided at the rear of the tray for receiving the sheet paper discharged by the discharging mechanism. The second step is arranged lower than the first step and positioned at the front portion of the tray.

In accordance with yet a still further aspect of the present invention, a printing apparatus includes a printing mechanism having a printing head and a platen, a discharging mechanism for transmitting sheet paper from the printing mechanism to a tray for discharged paper, and a supplying mechanism. The supply mechanism includes a tray for storing paper which has a movable bottom plate, a roller for supplying sheet paper from the tray for supplying paper to the printing mechanism, and engaging mechanism for controlling relative motion of the bottom plate to the roller, whereby a sheet paper on the bottom plate is pressed against the roller and is released therefrom when the sheet of paper passes the roller.

BRIEF DESCRIPTION OF THE DRAWINGS

The above and other objects, features, and advantages of the present invention will become apparent from the following detailed description of illustrative embodiments thereof to be read in conjuction with the accompanying drawings in which like reference numerals designate the same elements and parts.

DESCRIPTION OF THE PREFERRED EMBODIMENT

In order to facilitate better understanding the present invention, the printing system of a polychromatic printing apparatus according to the present invention will now be described hereinbelow.

Figure 1:
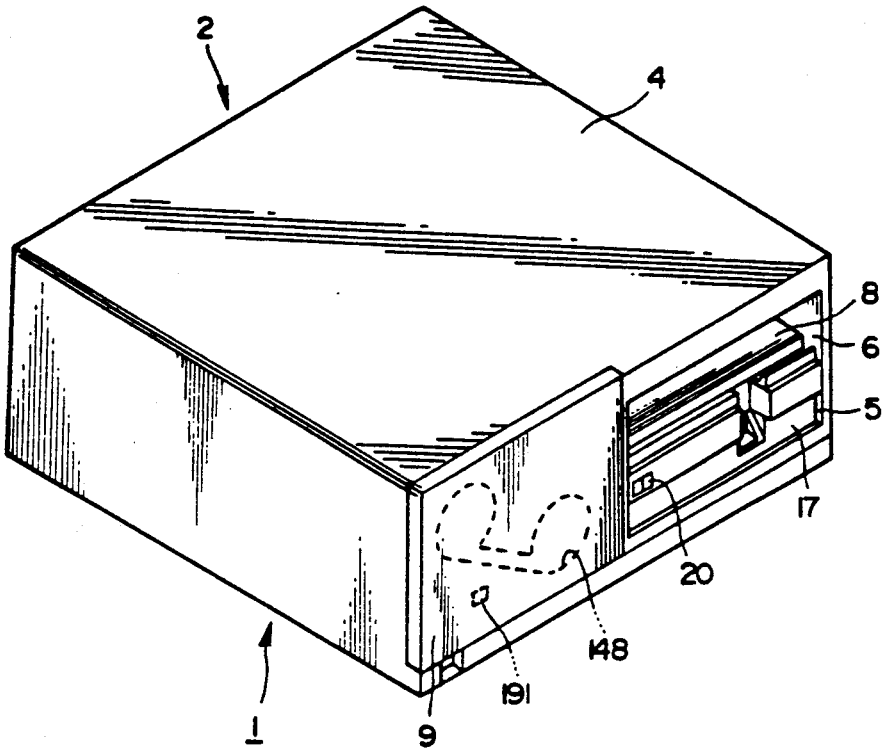
FIG. 1 is a perspective view of a color printing apparatus according to one embodiment of the present invention.

Referring now to the drawings, and to FIG. 1 a polychromatic thermal printing apparatus, in accordance with the present invention is shown. This printing apparatus 1 has a printer cabinet 2. which generally includes a rectangular frame type inner chassis 3 (shown in FIG. 2) and a box type outer chassis 4 covering the inner chassis.

As shown in FIGS. 2 to 6, a first tray housing 5 for receiving a feeding tray 17 and a second tray housing 6 for receiving a supporting tray 45 are disposed within the cabinet 2 at the front side thereof. The first and second tray housings 5 and 6 respectively are arranged on the right-hand side, (see FIG. 2), of the cabinet 2 and the second housing 6 is positioned above the first housing 5. A printing station 7 is provided on the left-hand side of the printing apparatus of FIG. 2 so as to face the tray housings 5 and 6.

In order to feed printing paper sheets 8 one by one to the printing station 7, a plurality of feeding rollers 10 are provided on a driving shaft 11. The shaft 11 is pivotably supported by a front plate 3*a* and a rear plate 3*b* of the inner chassis 3 below the first tray housing 5. Three ejecting rollers 12 for carrying the printing paper sheet 8 towards the second tray housing 6 are arranged on an ejecting roller shaft 13. The shaft 13 is rotatably supported between the front plate 3*a* and the rear plate 3*b* and is disposed between the printing station 7 and the second tray housing 6 (see FIG. 3). A platen 14 is provided above the printing station 7 and is arranged on a shaft 15 which is rotatably supported between the front plate 3*a* and the rear plate 3*b*. The printing station 7 also includes a ribbon cartridge housing 16 for storing a ribbon cartridge.

Figure 5:
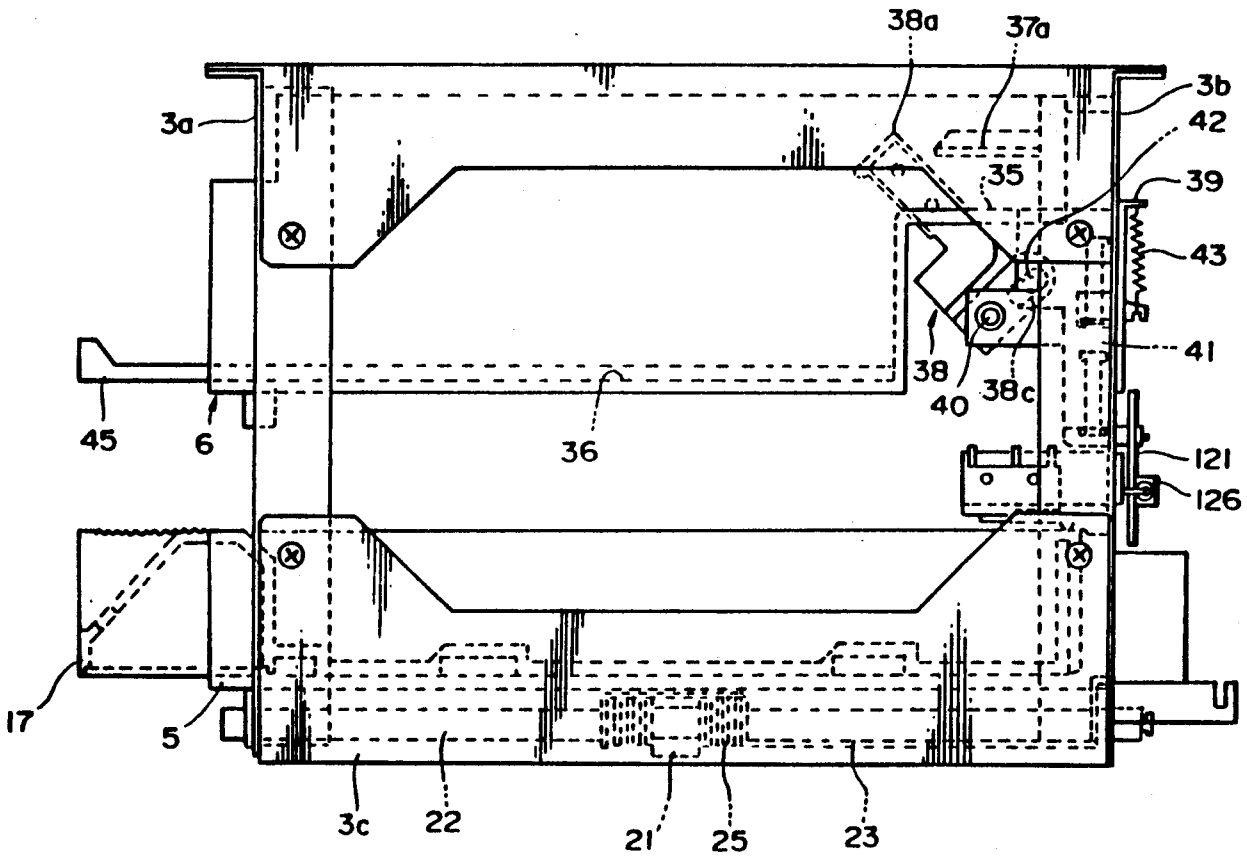
FIG. 5 is a partially cutaway side view of the color printing apparatus of FIG. 2.

As shown in FIG. 5, the tray housings 5 and 6 can be opened at the upper right side in front of the outer chassis or exterior surface 4 of the cabinet 2. The ribbon cartridge housing 16, as shown in FIG. 1, is covered by a detachable lid 9 at the left front side of the printing apparatus 1.

Figure 2:
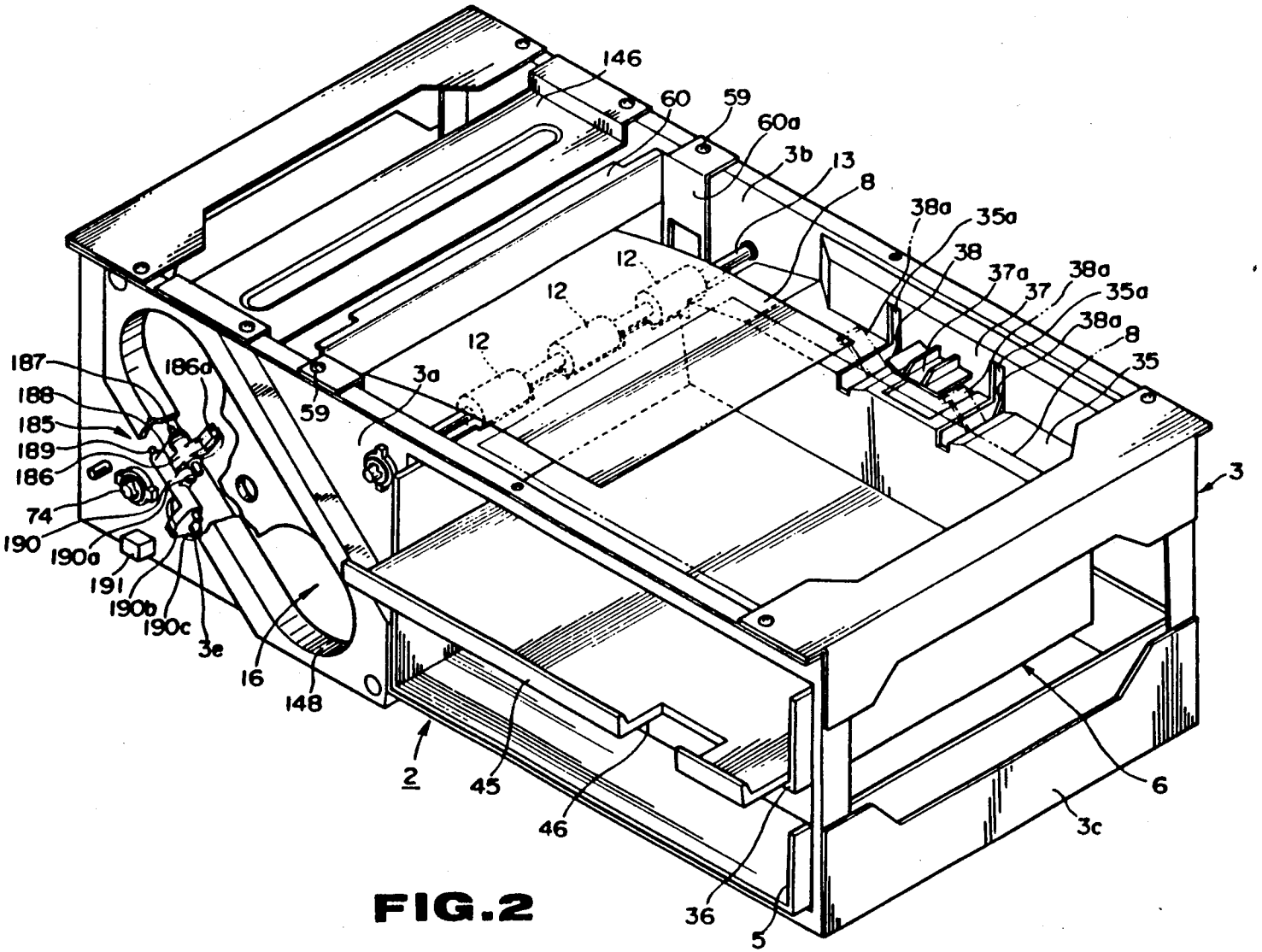
FIG. 2 is a perspective exploded view of the color printing apparatus of FIG. 1.
Figure 3:
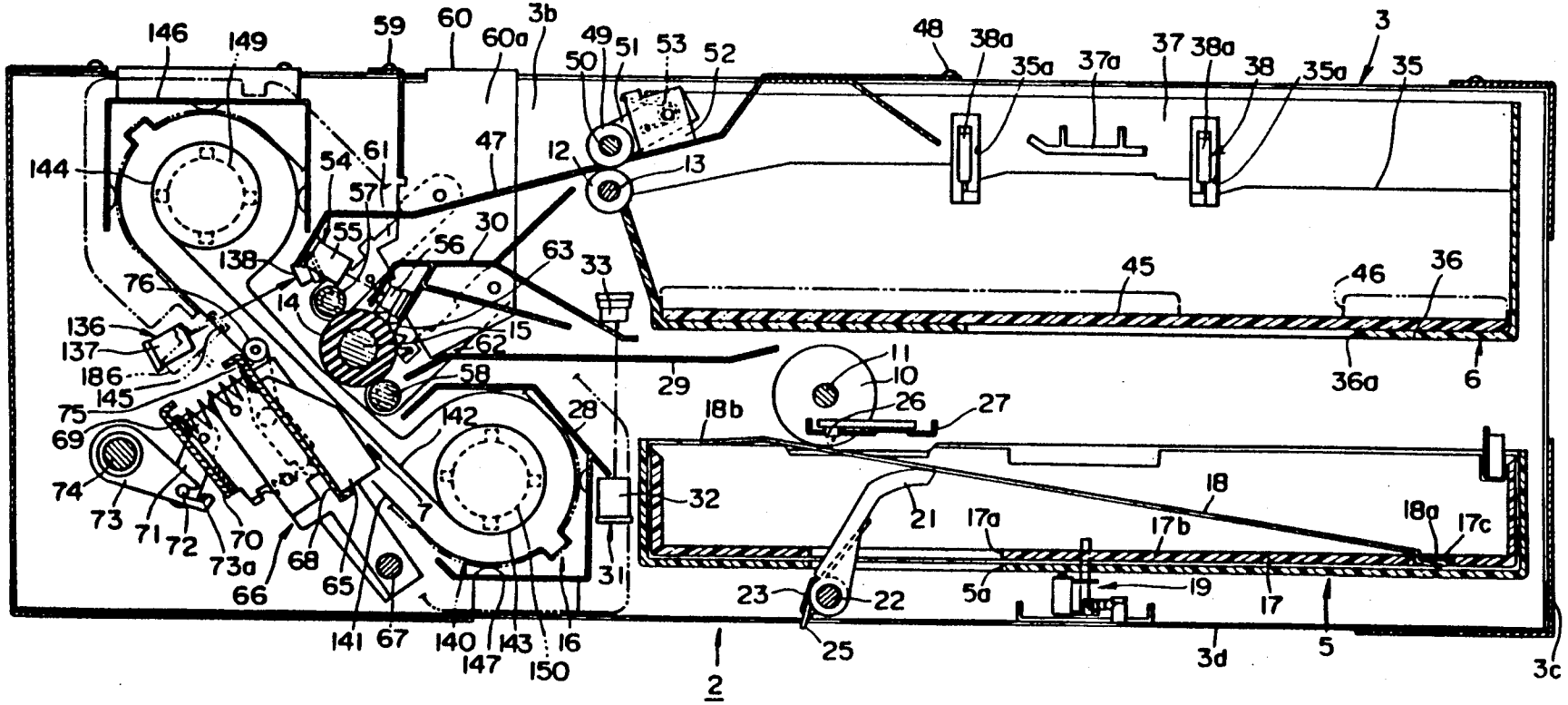
FIG. 3 is a from sectional view of the printing apparatus of FIG. 2.
Figure 4:
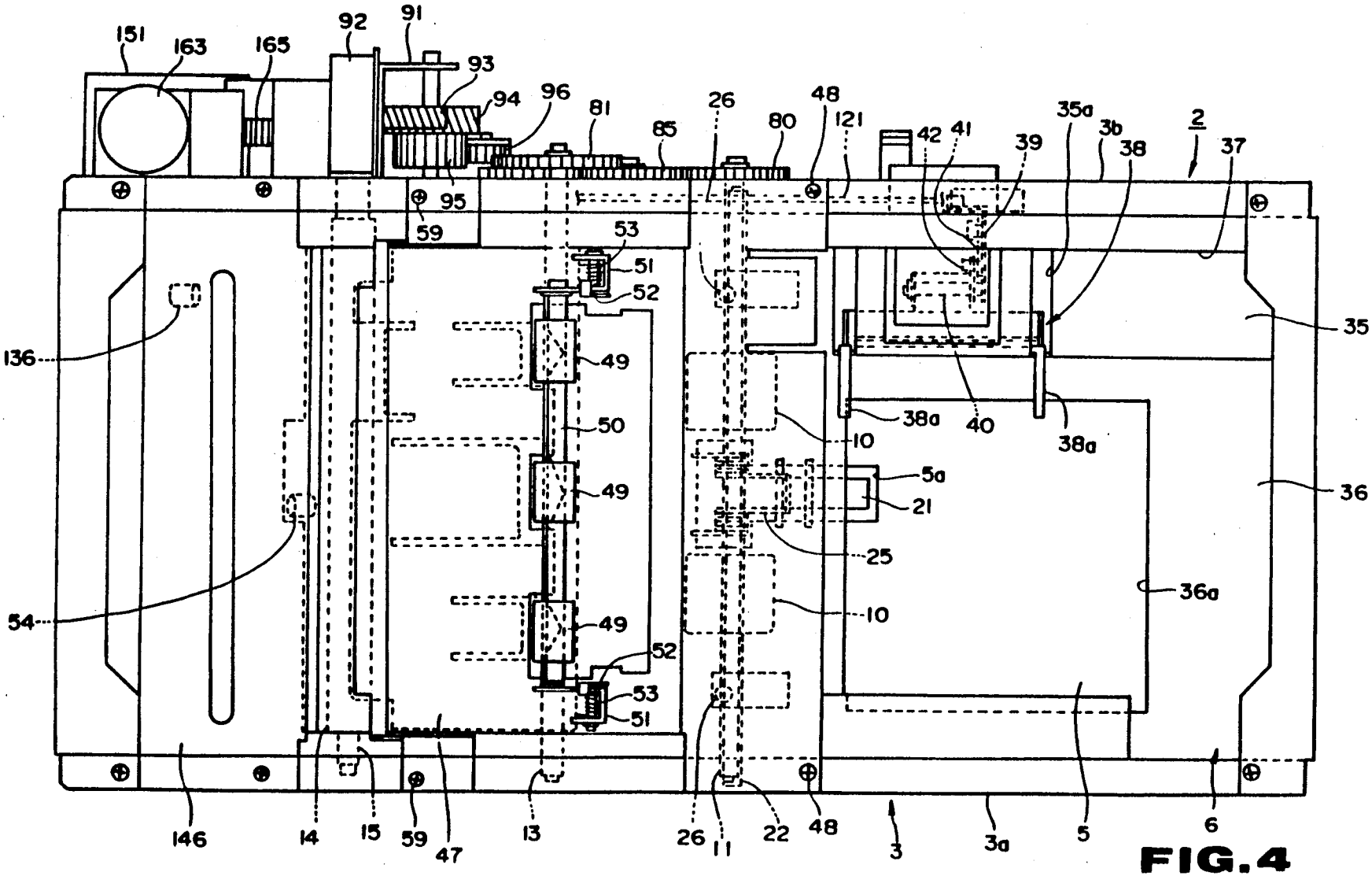
FIG. 4 is a top plane view of the printing apparatus of FIG. 2.

The first tray housing 5, as shown in FIGS. 2 and 3, is made of synthetic resin and is formed as a rectangular box with an open top and front. The housing 5 is located within an opening located at the right lower side of the printing apparatus 1. A rectangularly shaped opening 5*a* is formed in the bottom plate of the tray housing 5, beneath the pair of feeding rollers 10.

Figure 7:
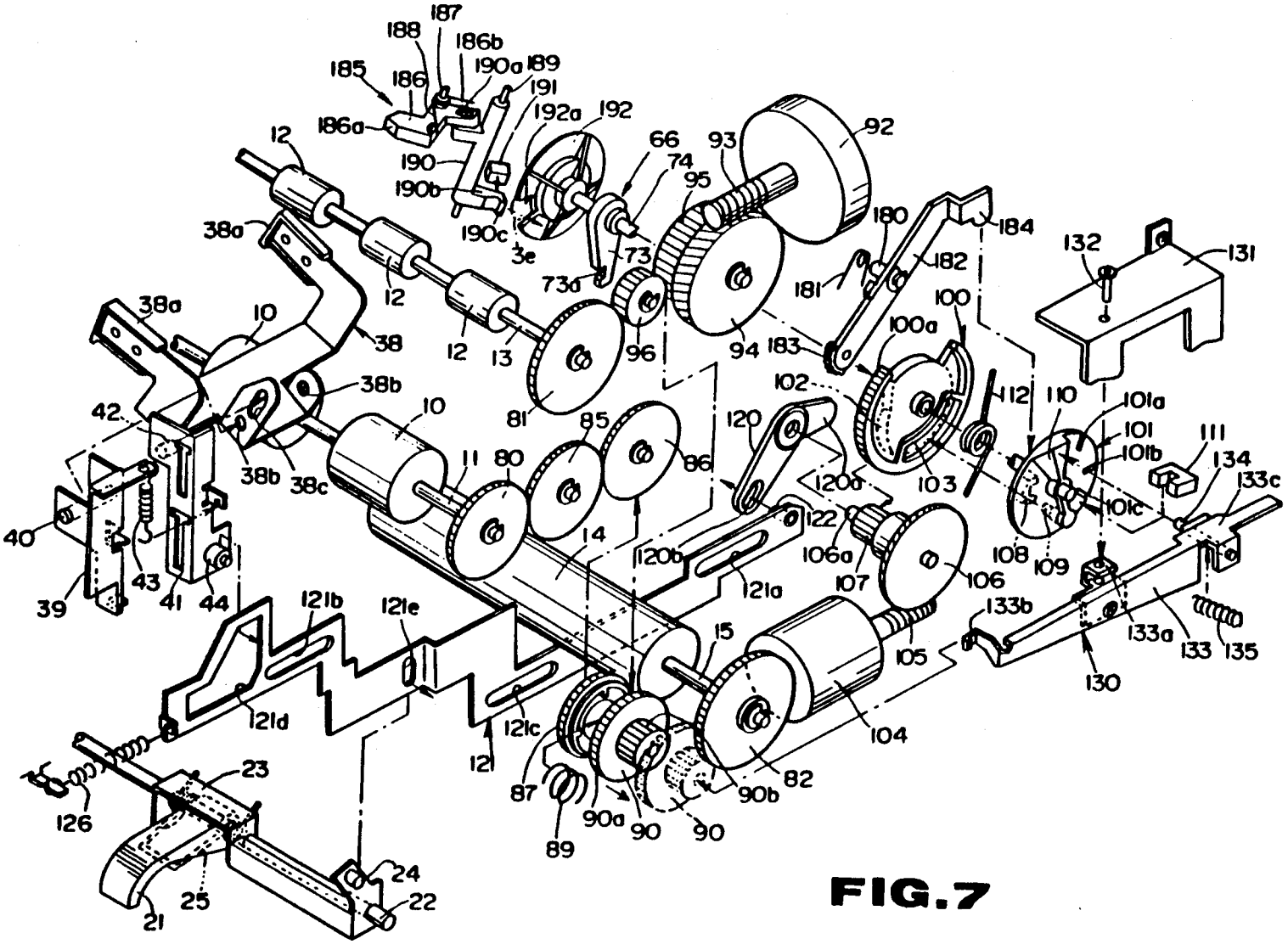
FIG. 7 is exploded perspective view of a preferred embodiment for a driving system used in conjunction with the color printing apparatus of the present invention.

A feeding tray 17 is made of a synthetic resin and, as shown in FIGS. 3 and 5, opens upwardly. The tray 17 is releasably received within the first tray housing 5. A rectangularly shaped opening 17*a* which is the same configuration as the opening 5*a* is provided in a bottom plate 17*b* of the feeding tray 17 and faces the opening 5*a*. In the right side of the bottom plate 17*b*, an elongated opening 17*c* extends parallel to a side wall of the feeding tray 17. The opening 17*c* is engageable with a folded edge 18*a* of a metal plate 18. The plate 18 is bent at the opposite edge 18*b* from the edge 18*a* and provides for a receiving plate for storing sheets of paper 8. A rotatable lever 21 for lifting the plate 18 up to the platen 14 is provided beneath the plate 18. The lever 21 is secured on a shaft 22 which is pivotably supported between the front plate 3*a* and the rear plate 3*b* of the inner chassis 3. In addition, as shown in FIG. 7, a torsion spring 25 is wound around the shaft 22 so as to urge the lever 21 upwardly. An actuating plate 23 is also installed on the shaft 22. Which has a pin 24 secured to an end portion thereof. The pin 24 is inserted into an elongated hole 121*e* provided in releasing means 121 in the form of a frame structure to be described hereinafter which extends from the rear plate side 3*b*. Lateral displacement of the frame structure 121 causes the lever 21 to rotate, which in turn thrusts the plate 18 against the feeding rollers 10 through the openings 5*a* and 17*a*. Causes the sheets of paper 8 to be pushed up against the feeding rollers under a fixed pressure regardless of the number of sheets. On the other hand, when the feeding tray 17 is withdrawn from the first tray housing 5, the lever 21 is positioned horizontally beneath the openings 5*a* and 17*a* by the displacement of the actuating plate 23.

A locking device 19 is provided on a bottom plate 3*d* of the inner chassis 3 below the first tray housing 5. The device 19 includes a lever for securing the feeding tray 17 within the tray housing 5. The locking device 19 is released by pushing an eject button 20 (shown in FIG. 1) provided along the front chassis 4 which allowing the feeding tray 17 to be withdrawn from the first tray housing 5.

A pair of reflecting type optical paper sensors 26 are provided beneath both ends of the driving shaft 11 of the feeding rollers 10 and are installed on a mounting plate 27. The paper sensors 26 are adapted for sensing the presence of paper sheets 8 stored within the feeding tray 17.

A C-shaped lower paper guiding member 28 is disposed between the platen 14 and the first tray housing 5. This guide member 28 guides printing paper sheets fed from the feeding rollers 10 toward the printing station 7. Additionally, the guiding member 28 defines a part of the ribbon cartridge housing 16. A middle paper guiding plate 29 extends from the lower side of the platen 14 toward the top of the feeding rollers 10. The paper sheets are fed through a feeding passageway defined by the lower paper guiding member 28 and the middle paper guiding plate 29. Furthermore, a Y-shaped upper paper guiding plate 30 is positioned above the middle paper guiding plate 29. The upper paper guiding plate 30 extends from the upper side of the platen 14 to the second ejecting rollers 12 and the lower side of the tray housing 6.

A photosensor 31 for detecting jamming of the paper sheet 8 is provided. The photosensor 31 includes a light emitting element 32 and a light receiving element 33. The light emitting element 32 is located between the upper paper guiding plate 30 and the second tray housing 6 while the light receiving element 33 is positioned between the lower paper guiding plate 28 and the tray housing 5. A beam of light projected from the light emitting element 32 transversely passes through the feeding passageway of the paper sheet 8 to the light receiving element 33. If paper is jammed in the feeding passageway, the beam of light emitted from the photosensor 31 is blocked, thereby providing an output signal indicating jamming.

The second tray housing 6, as shown in FIGS. 2 to 5, is in the form of a rectangular synthetic resin box which has openings in the front and upper sides respectively. The second tray housing 6 is provided at the printer upper right side between the front and the rear plates 3*a* and 3*b* of the inner chassis 3. The bottom of the housing is provided with an upper step 35 and a lower step 36. The step 35 is formed at the rear plate 3*b* side and defines "a first ejecting position" of printed paper sheets, while the step 36 is formed below the upper step 35 at the front plate 3*a* side and defines "a second ejecting position" thereof.

A parallel pair of elongated openings 35*a* are formed in the middle portion of the upper step 35 of the second tray housing 6 so as to extend to the upper end of a rear wall 37 which extends upwardly from the rear end of the upper step 35. A pair of paper pushers 38*a* for pushing the printed paper sheet from the upper step 35 toward the lower step 36 is provided on the end of a U-shaped pusher arm 38. The pusher arm 38 can swing the paper pushers from rear to front. A pair of holes 38*b* (shown in FIG. 7) formed in the base portion of the arm 38 receive a pin 40 which is installed on a mounting plate 39 arranged at the outside of the rear plate 3*b* to rotatably support the pusher arm 38. A pair of elongated holes 38*c* each formed above the hole 38*b* slidably receive a pin 42 which is positioned outwardly of the pin 40. The pin 42 is anchored on a sliding plate 41 for sliding vertically with respect to the mounting plate 39. A roller 44 associated with the releasing means to be described hereinafter in detail is mounted on the sliding plate 41. Moreover, a tension coil spring 43 hangs between the mounting plate 39 and the sliding plate 41 so as to urge the sliding plate 41 upwardly. The pusher arm 38 can therefore rotate about the pin 49 of the mounting plate 39 with the result that the pair of paper pushers 38*a* project upwardly above the upper step 35. A guiding flange 37*a* for guiding ejected paper sheets 8 onto the step 35 at the first ejecting position extends laterally from the rear wall 37.

Displacement of the releasing means causes the sliding plate 41 to move downwardly against the tensile force of the coil spring 41. This allows the arm 38 to swing about the pin 40 and thereby cause the pair of paper pushers 38*a* to push the paper ejected from the ejecting roller onto a receiving tray 45.

A rectangular opening is provided in the middle portion of the lower step 36. The opening allows withdrawing of the paper sheets 8 when feeding of the paper sheets is abnormal. The L-shaped flat receiving tray 45, as shown in FIGS. 3 and 5, is placed on the lower step 36. The receiving tray 45 is made of a synthetic resin and has a cut-out portion 46, as shown in FIG. 2, at front right side thereof which allows the stacked printed paper sheets in the tray removed Moreover, an end of an upper paper guiding lid plate 47 is secured by screws 48 on both upper surfaces of the front plate 3*a* and the rear plate 3*b* of the inner chassis 3 above the second tray housing 6. The other end of the plate 47 extends to the upper side of the platen 14. A shaft 50 is rotatably supported on the upper paper guiding lid plate 47 by a pair of arms 51. Three rotatable sub-rollers are arranged on the shaft 50. Each arm 51 is connected to a bracket 52 by a pin. A torsion spring 53 is wound around the pin. An end of torsion spring 53 is fixed in the arm 51 and the other end of which contacts on the upper wall of the bracket, urging the sub-rollers 49 to the ejecting rollers 12. The sub-rollers are rotatable according to the rotation of the ejecting rollers 12 to eject a printed paper sheet to the receiving tray 45.

A paper edge photosensor 54 including a light emitting element 55 and a light receiving element 56 is provided above the platen 14. The light emitting element 55 is installed on the end of the upper paper guiding lid plate 47 while the light receiving element 56 is disposed on the end of the upper paper guiding plate 30 just above the platen 14. A beam of light propagated from the light emitting element 55 passes transversely through the paper ejecting path toward the light receiving element 56. The paper edge photosensor 54 detects whether an edge of a printing paper sheet 8 is in the starting position.

In the printing station, as shown in FIG. 3, the rubber platen 14 is provided at the center thereof. A pair of pinch rollers 57 and 58 are positioned diametrically opposed with regard to the center of the platen 14 so as to contact the outer surface of the platen. The pair of pinch rollers 57 and 58 are made of metal and are rotatably supported by ends of a pair of arms 61 and 62 respectively. The arms 61 and 62 are supported by a pin on side face 60*a* of a plate 60 which is supported over the front plate 3*a* and the rear plate 3*b* of the inner chassis 3. A tension spring 63 is disposed between the pair of arms 61 and 62 so as to urge the pinch rollers 57 and 58 to the platen 14. This keeps the outer peripheral surface of the pinch rollers in contact with the outer surface of the platen to cause the pinch rollers to rotate freely according to the platen rotation. It is to be noted that the combination of the rubber platen 14 and the metal pinch rollers 57 and 58 allows the sheet of paper 8 fed from the feeding tray 17 to be easily wrapped about the peripheral surface of the platen.

Figure 8:
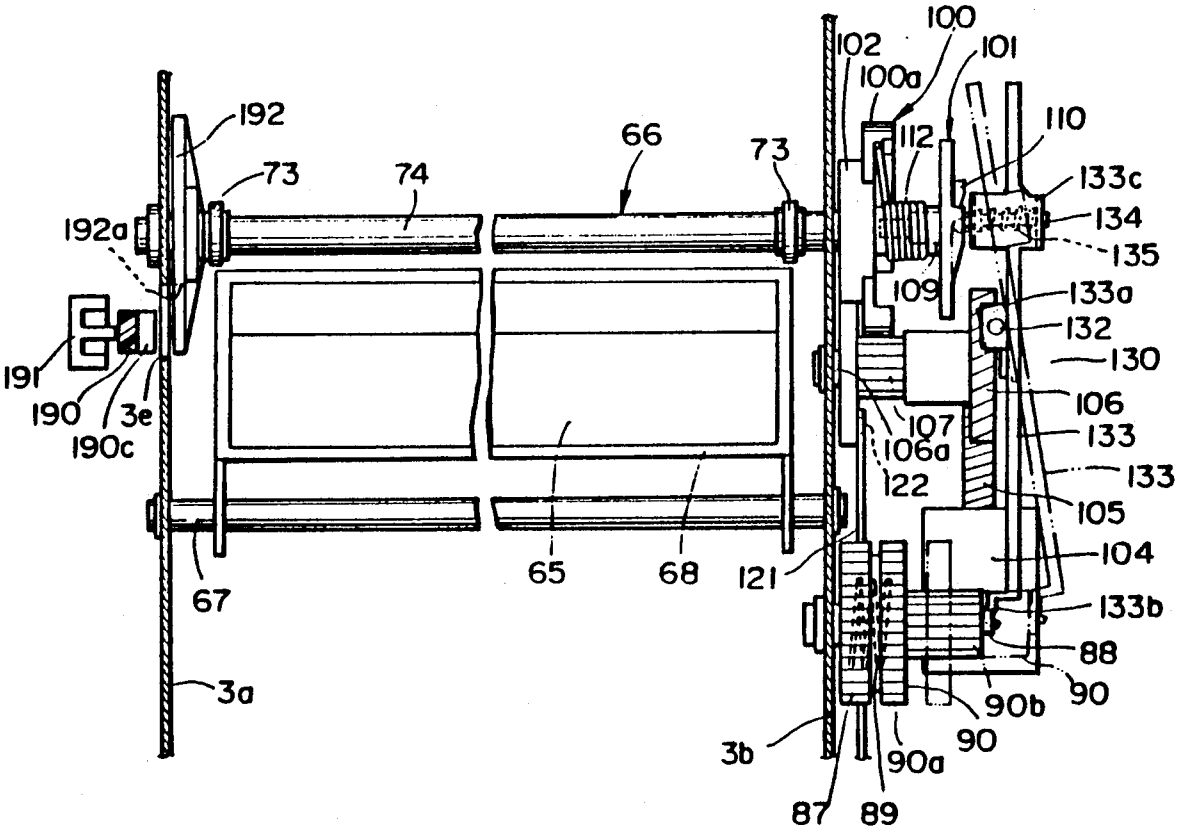
FIG. 8 is a plane view of a preferred embodiment a head driving system to be used in conjunction with the printing apparatus of the present invention.

With reference to FIGS. 3 and 8, a head moving device 66 is provided under the platen 14 of the printing station. The head moving device 66 is adapted for moving a thermal head 11 (i.e. a printing head) 65 into contact with the periphery of the platen or for being removed therefrom. The head moving device 66 includes a head supporting arm 68, a sub-head supporting arm 70, a pair of linkage plates 71, a pair of driving arms 73, a driving shaft 74, and a ribbon roller 76. The head supporting member 68 is movably supported by a shaft 67 disposed between the front and the rear plates 3*a* and 3*b* of the inner chassis 3 and is adapted for securing the thermal head 65. The sub-head supporting member 70 is supported by pins at both sides of the head supporting arm 68 and a coil spring 69 is interposed between the head and sub-head supporting arms 68 and 70. One end portion of the pair of linkage plates 71 is rotatably connected to the side wall portions of the sub-head supporting arm 70 by a pin, while other portion thereof engages a cut-out portion 73*a* formed in the driving arm 73 by a pin 72. Also, a sub-arm 75 is installed on the printing head 65 at its corner and includes ribbon roller 76 at its end. The driving arm 73 is fixed on the driving shaft 74 which is rotatably supported between rear and front plates 3*a* and 3*b* and rotates in accordance with the rotation of the driving shaft. It will be appreciated that with this arrangement, when the driving arm 73 rotates about the driving shaft, the head supporting arm 68 and the sub-head supporting member 70 with the thermal head 65 are lifted upwardly toward the platen 14.

Figure 6:
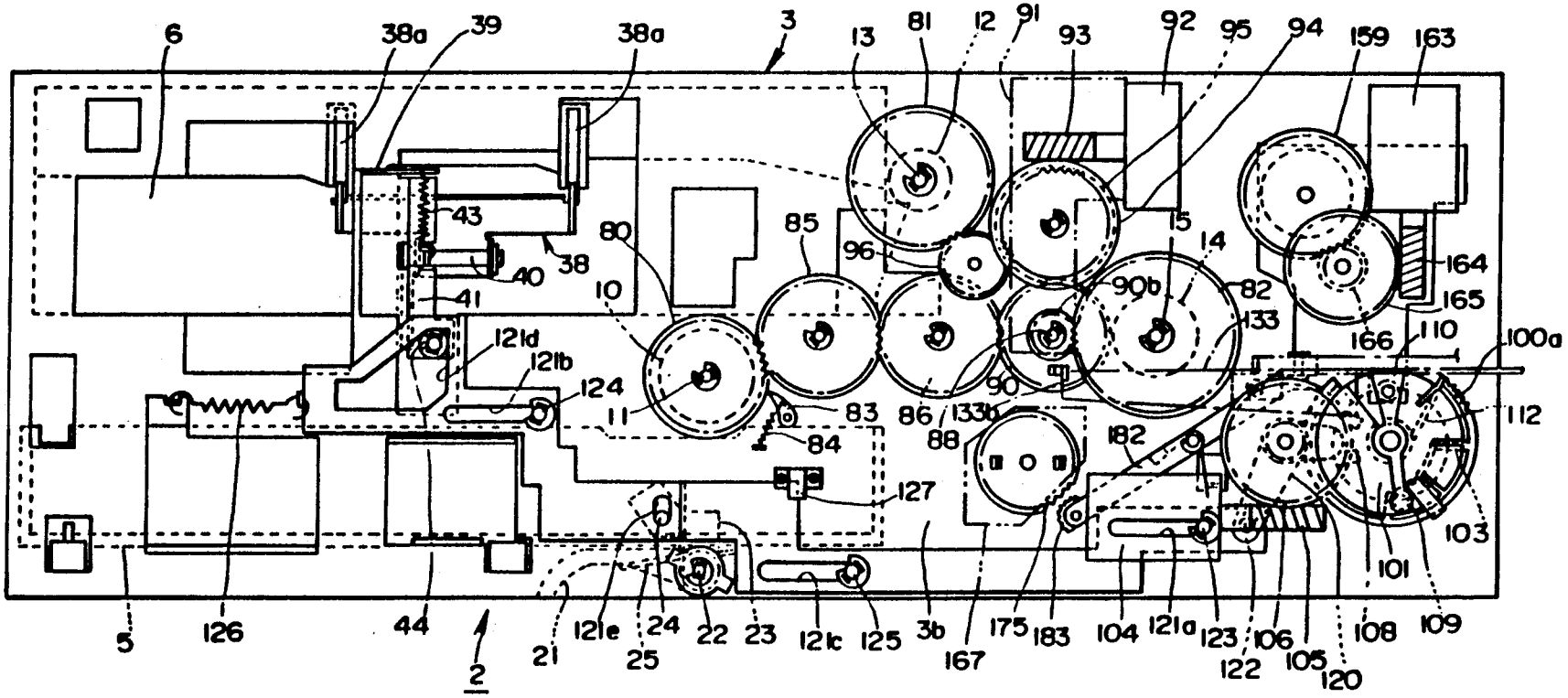
FIG. 6 is a rear view of the color printing apparatus of FIG. 2.

With reference to FIGS. 6 and 7, at the outside of the rear plate 3*b* of the inner chassis 3, a driving gear 80 for the feeding rollers 10 is attached on the driving shaft 11 of the ejecting rollers 10. An ejecting roller driving gear 81 is installed on the ejecting roller shaft 13 of the ejecting roller 12. A platen driving gear 82 is installed on the shaft 15. Teeth of the feeding roller driving gear 80 engage with a ratchet lever 83 which is urged downwardly by a tension spring 84 so as to allow the driving gear 80 to rotate in the same direction as the paper sheets 8 are feed. Reverse rotation of the feeding roller driving gear 80 is therefore prevented. The teeth of feeding roller driving gear 80 meshes with first and a second idler gears 86 and 87 (shown in FIG. 7) via an intermediate gear 85. The second idler gear 87 is supported by a shaft 88 and has a compression spring 89 adapted 10 contact with and release from a shift gear 90. The shift gear 90 includes a large external gear 90*a* and a small external gear 90*b*. The large gear 90*a* meshes with a driving gear 95 which is fixed to a worm gear 94. The worm gear is in meshing engagement with a worm 93 provided on a drive shaft of a pulse motor 92 (a stepping motor) which functions as a second driving source. The pulse motor 92 is installed on a mounting plate 91 of the rear plate 3*b*.

The ejecting roller driving gear 81 meshes with a pinion gear 96 which always meshes with the driving gear 95. As a result thereof, the rotation of the ejecting rollers 10 is always caused by the rotation of the worm 93 of the pulse motor 92. The platen driving gear 82 is engageable with and releasable from the small external gear 90*b* of the shift gear 90 by a driving force changing device 130 to be described hereinafter. The movement of the shift gear 90 as a result of the driving force changing device 130 causes either the rotation of the feeding rollers 10 or the rotation of the platen 14.

With reference to FIGS. 7 and 8, a head cam gear 100 is rotatably supported outwardly from rear plate 3*b* by the end of the head driving shaft 74. Also, the a disk type head cam 101 is fixed on the end of the head driving shaft 74 and extends from the head gear cam 100. The head cam gear 100 includes a cam surface 102 projecting toward the rear plate 3*b*, a rib 103 extending from the opposite side thereof, and a gear 100*a*. The cam surface 102 includes a straight portion and two curved portions. The gear 100*a* is positioned between the cam surface 102 and the rib 103 and has a cut-out portion. A small gear 107 of a worm gear 106 is in meshing engagement with the gear 100*a*. The small gear 107 engages a worm 105 of a pulse motor 104 (a stepping motor) which acts as a first driving source. The pulse motor 104 is installed on a mounting plate (not shown) extending from the rear plate.

The head cam 101 includes three slits 101*a*, 101*b*, and 101*c*, a U-shaped cam surface 108 which acts as a brake arm, a driving pin 109, and a cam surface 110. The slits 101*a*, 101*b*, and 101*c* extend radially inwardly of the periphery of the cam 101 and are separated from each other by a predetermined distance. A photosensor 111 includes a light emitting element and a light receiving element. A beam of light projected from the light emitting element passes through the slits detect the "before printing", "printing", and ejecting modes of the printing apparatus 1. The U-shaped cam surface 108 projects from a surface of the head cam 101 toward the head cam gear 100 and the cam surface 110 is formed on the opposite surface thereof. The driving pin 109 is adapted for engaging the rib 103 of the head cam gear 100. The rotational displacement of the head cam gear 100 therefore causes the head cam 101 to rotate. A torsion spring 112 is interposed between the head cam gear 100 and the head cam 101 and urges the driving pin 109 into contact with an end of the rib 103 to maintain the positional relationship therebetween.

An end 120*a* of a feeding cam lever 120 functioning as a cam follower contacts the outer peripheral surface of the cam 102 of the head cam gear 100. The cam lever 120 is pivotably supported by a shaft 106*a* of the worm gear 106. The opposite end portion of the cam lever 120 has an elongated opening 120*b* into which a pin 122 secured on the actuating plate 121 is inserted. The rotation of the cam lever 120 causes the actuating plate 121 to move laterally, which in turn causes the feeding lever 21 and the pusher arm 38 described above to swing. The actuating plate 121 is elongated and is folded so as to form a step. Elongated openings 121*a*, 121*b*, and 121*c* are provided at the both end portions and the central portion of the actuating plate 121 respectively. Corresponding pins, for supporting the actuating plate, projecting from the rear plate 3*b* of the inner chassis 3 are inserted into these openings. In addition, triangular opening 121*d* receives the roller 44 of the slide plate 41 is formed in the end portion of the plate 121 adjacent to the feeding lever 21. Since the roller 44, as described above, is urged upwardly by the tension force exerted by the spring 43, it is maintained in contact with an upper inside edge of the opening 121*d*. Lateral displacement of the actuating plate 121 therefore causes the roller 44 to move vertically. The vertically elongated opening 121*e* receives a pin 24 anchored on the actuating plate 23 of the feeding lever 21 adjacent to pusher arm 38. A tension spring 126 is placed over an end of the actuating plate 121 and a hook provided on the rear plate 3*b* urging the actuating plate to maintain in a predetermined position. However, the lateral displacement of the actuating plate 121 parallel to the surface of the rear plate 3*b* due to the rotation of the cam lever 120 causes the pusher arm 38 and the feeding lever 21 to rotate. A photosensor 127 (See FIG. 6) for sensing the arrival of the print paper sheet 8 at the platen 14 is provided above the elongated opening 121*c* of the actuating plate 121.

The driving force transmitted to the feeding roller driving gear 80 of the shift gear 90 or the platen driving gear 82 is changed by the driving force changing device 130. The driving force changing device 130, as shown in FIGS. 7 and 8, includes a shift lever 133 which is pivotably supported, at its center by a pin 132 secured on a mounting plate 131. The mounting plate is provided on the rear plate 3*b* as to swing toward the shift gear 90 or the head cam 101. An end portion 133*b* of the shift lever 133 is folded into an L-shape to contact a side surface of the small gear 90*b* of the shift gear 90. A pin 134 having a flange is, as shown in FIG. 8, disposed within a U-shaped base portion 133*c* of the shift lever 133 functioning as a cam follower. A coil spring 135 is arranged between the flange of the pin 134 and an inner wall of the base portion 133*c* so as to urge the pin 134 into contact with the cam surface 110. The shift lever 133 swings about the pin 132 while following the cam surface 110. Therefore, when the head cam rotates and the pin 134 is positioned on the projecting top portion of the cam surface 110, the end portion 133*b* of the shift lever 133 forces the shift gear 90 against the compression force of the compression spring 89 so as to come in contact with the second idler gear 87. The engagement both between small gear 90*b* and the platen driving gear 82 and between the large gear 90*a* and the driving gear 95 of the pulse motor 92 is therefore removed. As a result thereof driving torque is not transmitted to the feeding roller 10. When the pin is positioned on the plate surface of cam surface 110, the end portion 133*b* of the shift lever 133 shifts outwardly due to the compression force of the spring 89. In this position the small gear 90*b* of the shift gear 90 meshes with the platen driving gear 82 and the large gear 90*a* of the shift gear 90 meshes with the driving gear 95. The driving torque of the pulse motor 92 thereby rotates the platen 14.

As shown in FIG. 3, the ribbon cartridge housing 16 stories a ribbon cartridge 140. The ribbon cartridge 140 includes a supply reel 143 and a take-up reel 144. The supply reel 143 is provided with a ribbon 142 having continuous printing areas formed with yellow (Y), magenta (M), and cyanogen (C). The take-up reel 144 is rotatably mounted within the cartridge so as to wind the ribbon withdrawn from the supply reel. A locking hole 145 associated with a locking device to be described hereinafter is provided in the lower surface of the cartridge body 141. The leader of the Y color section of the ribbon 142 is detected by a light transmission type optical sensor 136, which includes a light emitting element and a light receiving element.

The ribbon cartridge housing 16 is defined by an upper holding plate 146 of substantially U-shaped cross section and a lower holding plate 147 of substantially L-shaped cross section. The upper holding plate 146 is arranged so as to support the take-up reel 144 side of the cartridge. The lower holding plate 147 is adapted for holding the supply reel side 143. A ribbon cartridge access opening 148 for inserting the ribbon cartridge 140 into the housing 16 is, as shown in FIG. 2, formed in the front plate 3*a*.

Figure 9:
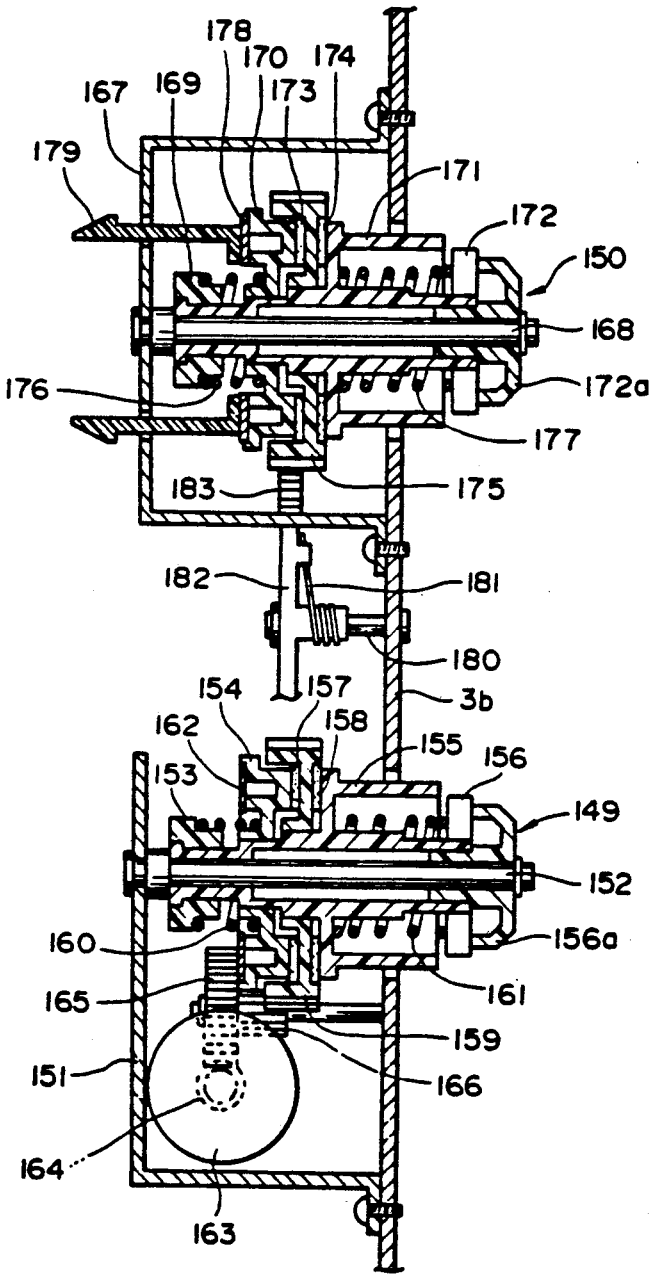
FIG. 9 is a top view of a ribbon cartridge driving system.
Figure 10:
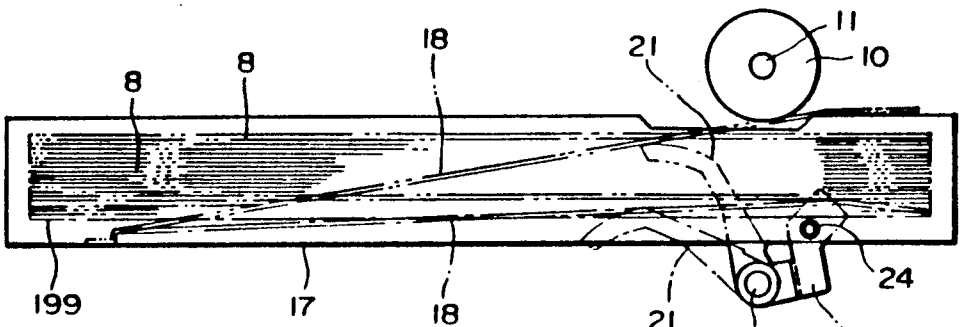
FIG. 10 is an elevational view of a feeding tray of a printing apparatus of the present invention.
Figure 11:
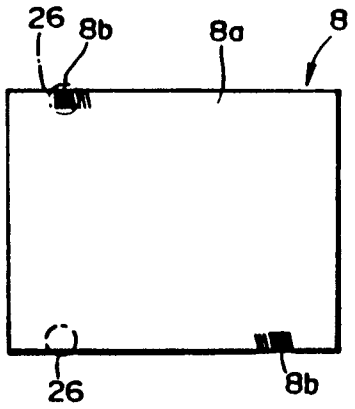
FIG. 11 is a top plane view of a conventional type printing paper sheet which is used in conjunction with the printing apparatus of the present invention.

A take-up reel table 149 for the take-up reel 144 and a supply reel table 150 for the supply reel 143 are arranged diagonally on the rear plate 3*b*. The take-up reel table 149, as shown in FIG. 9, includes a supporting axis 152, a spring retainer 153, a felt retainer 154, a limiter shaft 155, a reel flange 156, a limiter gear 159, compression springs 160 and 161, and a light reflecting plate 162 for a photo-sensitive device. The supporting axis 152 is fixed within an L-shaped mounting cover 151 so as to project inwardly from the rear plate 3*b*. The spring retainer 153, the felt retainer 154, the limiter shaft 155, and the reel flange 156 rotate in kind with the rotation of the supporting axis 152.

Felt pads 157 and 158 are provided on both surfaces of the limiter gear 159. The felt pad 157 is interposed between the end surface of the limiter shaft 155 and the limiter gear 159 while the felt pad 158 is also disposed between the felt retainer 154 and the latter. The compression spring 160 is arranged between the spring retainer 153 and the felt retainer 154 so as to urge the latter to the bottom flange of the limiter shaft 155. This establishes frictional contact among the felt retainer 154, the limiter gear 159, and the limiter shaft 155 via the felt pads 157 and 158. The compression spring 161 is disposed within a housing of the limiter gear 155 so as to thrust the reel flange 156 toward a reel hub 156*a*. The limiter gear 159 rotates with the limiter shaft 155 and the felt retainer 154 by the felt pads 157 and 158.

The circular light reflecting plate 162 is secured to the felt retainer 154 and includes a photo-sensitive device operable to detect rotation of the take-up reel 144. Moreover, the limiter gear 159 is in meshing engagement with a small gear 166 of a worm gear assembly 165 which is engageable with a worm 164 provided on the driving shaft of a driving motor 163 secured to the mounting cover 151. With this arrangement, the take-up reel is rotatable against brake force exerted by the compression spring 160 by the felt pad 157. The reel flange 156 is formed so as to engage with a take-up ribbon reel (a ribbon bobbin) 144 of the ribbon cartridge 140.

The supply reel table 150 includes generally a supporting axis 168, a spring retainer 169, a felt retainer 170, a limiter shaft 171, a reel flange 172, a limiter gear 175, compression springs 176 and 177, and a spring housing 179 which projects outwardly through the mounting housing. The supporting axis 168 is fixed in a U-shaped mounting housing 151, at one end so that the other end thereof projects inwardly from the rear plate 3*b*. The reel flange 172 supports a supply ribbon reel (a ribbon bobbin) 143, shown in FIG. 3, of the ribbon cartridge 140. The spring retainer 169, the felt retainer 170, the limiter shaft 171, and the reel flange 172 rotate in kind with the rotation of the supporting axis 168. Felt pads 173 and 174 are provided on both surfaces of the limiter gear 175. The felt pad 173 is interposed between the bottom flange of the limiter shaft 171 and the limiter gear 175 while the felt pad 174 is also disposed between the felt retainer 170 and the latter. The compression spring 176 is arranged between the spring retainer 169 and the felt retainer 170 so as to urge the latter to the bottom flange of the limiter shaft 171. This establishes frictional contact among the felt retainer 170, the limiter gear 175, and the limiter shaft 171 via the felt pads 173 and 174. The compression spring 177 is disposed within a housing of the limiter gear 171 so as to thrust the reel flange 172 against a reel hub 172*a*. The limiter gear 175 rotates with the limiter shaft 171 and the felt retainer 170 via the felt pads 173 and 174. A supporting shaft 180 which pivotably supports a brake arm 182 is installed on the rear plate 3*b* between the take-up reel table 149 and the supply reel table 150. The brake arm 182 has, as is shown in FIG. 7, an indented portion 183 at one end for meshing with the limiter gear 175 and a cam follower 184 at its other end. A helical tension spring 181 is wound around the supporting shaft 180 so that the cam follower 184 is kept in contact with the cam surface 102, causing the cam follower to move according to the configuration of the cam surface. The engagement between the indented portion 183 and the limiter gear 175 is established by the rotation of the cam 102.

With this arrangement, vertical displacement of the limiter gear 175, against the spring force exerted by the compression springs 176 and 177, allows its gear teeth to be engaged with and to be released from the indented portion 183 of the brake arm 182. In the printing operation, after completion of feeding a print paper sheet 8 to the platen 14 and upon winding an ink-ribbon after printing, engagement between the indented portion 183 and the limiter gear 175 is released. This causes the supply reel table 150 to rotate against the slight brake force caused by the frictional contact as described above.

As aforementioned, a locking hole 145 is provided in the ribbon cartridge 140. The locking hole 145 receives a hook 186, shown in FIGS. 2 and 3, to lock the ribbon cartridge 140 when it is inserted within the ribbon cartridge housing 16. The hook 186 is, as shown in FIGS. 2, 3, 7, and 8, rotatably supported on a U-shaped mounting housing (not shown), by a shaft and a helical torsion spring 188. The torsion spring 188 is positioned beneath the ribbon cartridge access opening 148 and at the middle section thereof. The top end portion 186*a* of the hook 186 is engageble with the locking hole 145. A pin 190*a* of an ejecting arm 190 is inserted into an elongated opening formed in the base end portion. The ejecting arm 190 is pivotably supported by a shaft 189 on the U-shaped mounting housing. As such, depression of an eject button 191 causes a barbed portion 190*b* to be inserted through a bore 3*e*. A circular eject stopper 192, having a U-shaped cut-out portion 192*a* is disposed internally of bore 3*e*. The eject stopper 192 is connected to the head cam 101 via shaft and therefore rotates in accordance with rotation of the head cam 101. Thus, before printing, the eject stopper 192 is angularly positioned so that the top end 190*c* of the barbed portion 190*b* faces the cut-out portion 192*a*. The depression of the eject button 191 causes the top end 190*c* to be inserted into the cut-out portion 192*a*, rotating the ejecting arm 190. This causes the hook 186, to rotate and thereby disengage the hook 186 from the locking hole 145. This allows the ribbon cartridge 140 to be removed from the printer. During printing, the cut-out portion 192*a* shifts from the bore 3*e*. If the eject button 191 is depressed, the ribbon cartridge is not necessarily removed.

Figure 12:
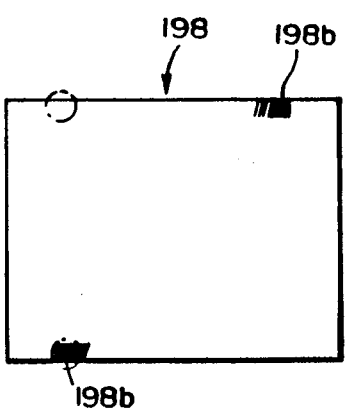
FIG. 12 is a top plane view of a printing paper sheet for an OHP which is used in conjunction with the printing apparatus of the present invention.
Figure 13:
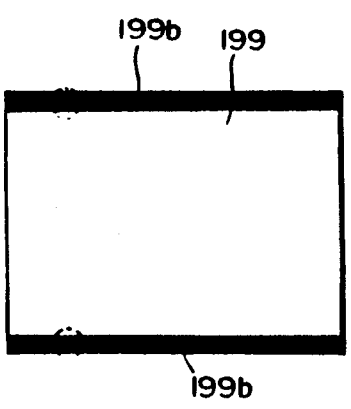
FIG. 13 is a top plane view of a protection sheet which is used in conjunction with the printing apparatus of present invention.

The printing paper sheets 8, as shown in FIGS. 10 to 13, are stored within the feeding tray 17 with the printing surfaces 8*a* facing downwardly. At predetermined positions on both side edges of the printing surfaces 8*a*, a bar code 8*b* is printed. FIG. 12 shows a paper sheet 198 for an OHP (Over Head Projector). On the printing surface of the OHP paper sheet 198, bar codes 198*b* are printed. FIG. 13 shows a protection sheet 199 for protecting from damage the printing surface in the lowermost printing paper sheet of a stack of paper sheets within the feeding tray 17. Bar codes are printed indicating the end of the paper supply on both side edges of the protection sheet 199.

With reference to FIGS. 14 to 24, the printing operation of the printing apparatus according to the present invention will be described hereinbelow.

Figure 14:
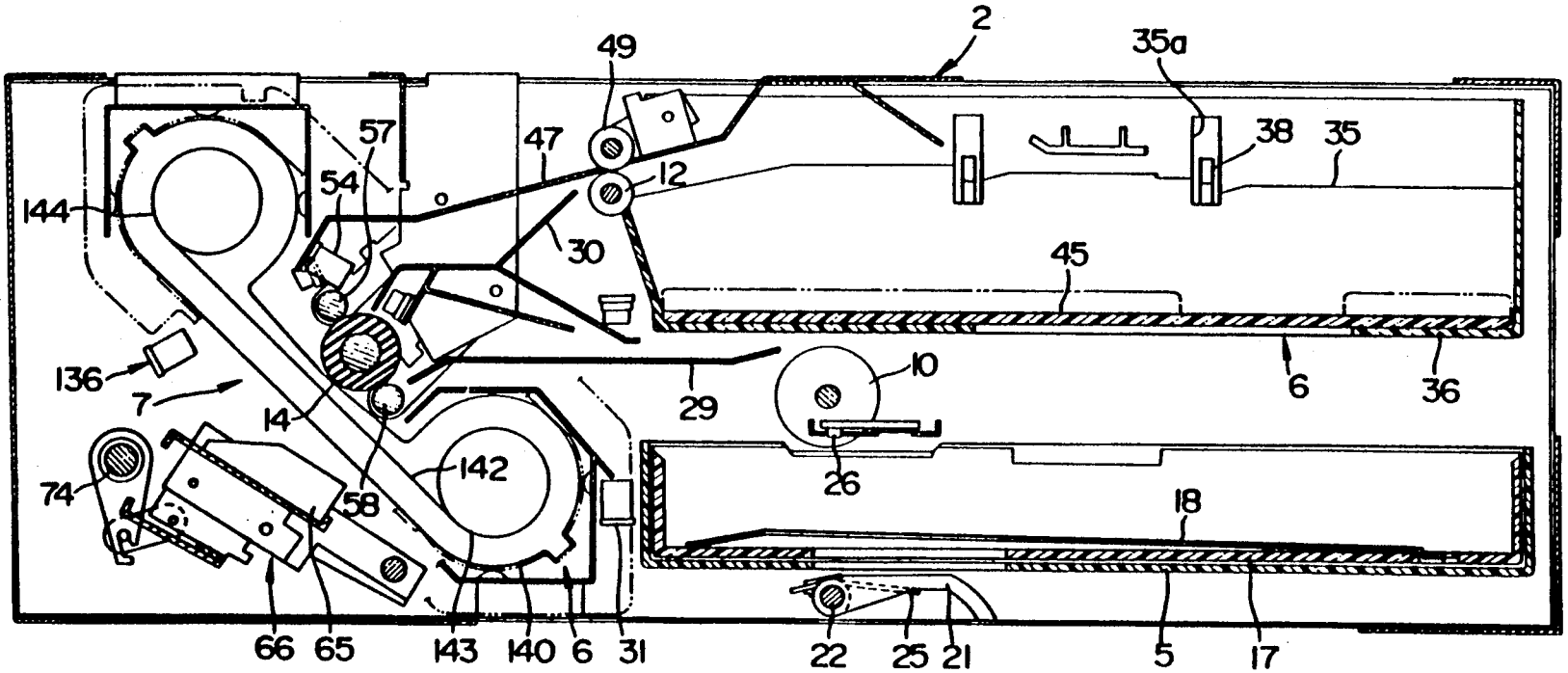
FIG. 14 an elevational view showing a paper feeding mechanism used in conjunction with the printing apparatus of the present invention prior to printing.
Figure 22:
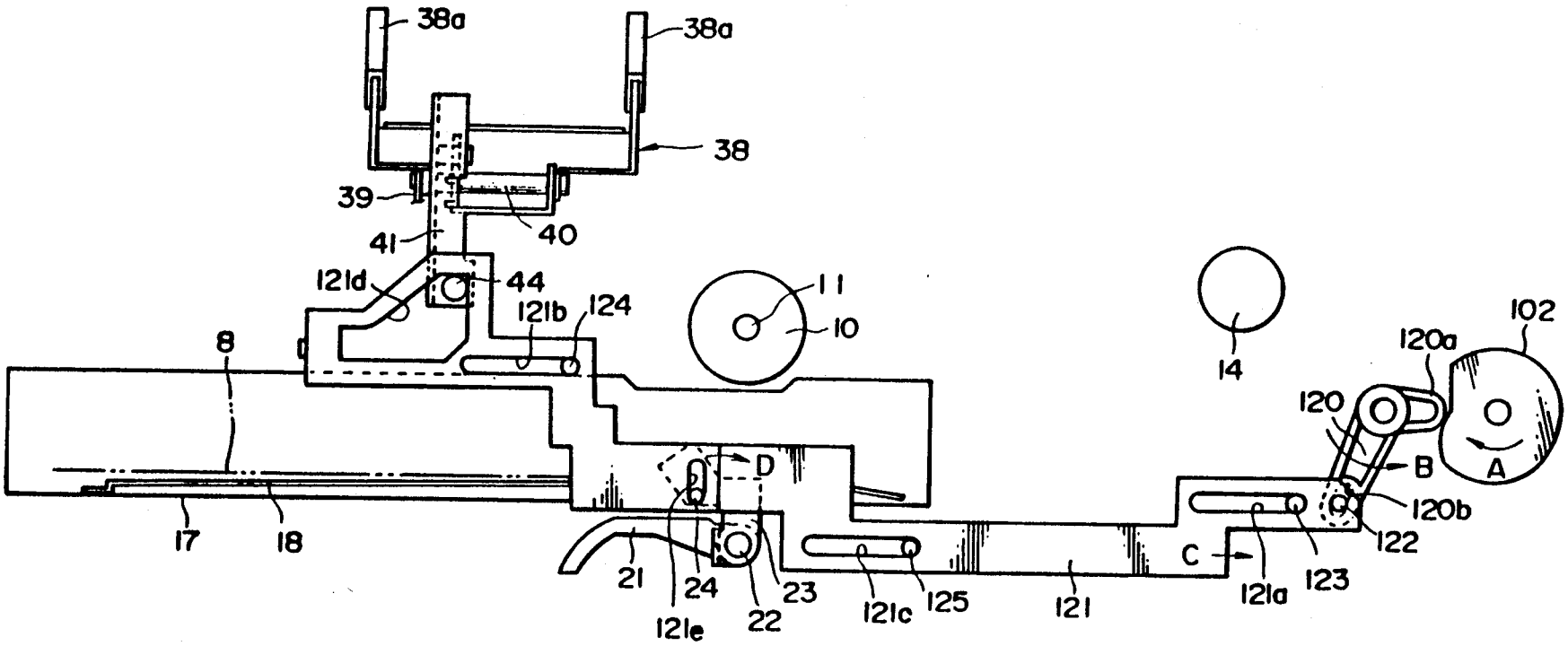
FIG. 22 is an explanatory view which shows a mechanical relationship between a pair of paper pushers and a feeding lever for a feeding tray before printing.

As shown in FIG. 14, in an initial state before printing (or when the feeding tray 17 is loaded or unloaded), the lever 21 is laid horizontally. The pusher arm 38 projects upwardly on the upper step 35 of the second tray housing 6 so as to be slightly inclined forward as shown in FIG. 22. On the other hand, the ribbon cartridge 140 is stored within the ribbon cartridge housing 16 and secured therein by the locking device 185.

With this arrangement, a print start button (not shown) provided on an operating panel of the printing apparatus 1 is depressed to operate the pulse motor 104 rotating the head cam gear 100, which in turn causes the cam 102 formed integrally with the head cam gear to rotate in the direction of an arrow "A" as shown in FIG. 22. The rotation of the cam 102 causes the cam lever 120 to move, in the direction of an arrow "B", according to the configuration of the cam. This movement laterally actuates the actuating plate 121 in the direction of an arrow "C". This causes the actuating plate 23 of the lever 21 to rotate about the shaft 22 in the direction of an arrow "D" thereby swinging the lever 21 to lift the bottom plate 18 the upwardly toward the feeding rollers 10. Secure contact between the printing paper sheet 8 and the outer peripheral surface of the feeding rollers 10 is therefore established under a predetermined pressure determined by the flexibility of the bottom plate 18 provided by the torsion spring 25. At this time, the pair of paper sensors 26 detect the presence of the bar code **8*b* printed on the printing surface 8*a* of the paper sheet 8 and provide a signal indicating that the printing surface is facing downwardly. The paper sensors 26 read the bar code 198*b*, as shown in FIG. 12, after they provide a signal indicating that it is an OHP paper sheet 198. Alternatively, when the paper sensors 26 detect the codes 199*b* printed on both side edges of the paper protecting sheet 199**, as shown in FIG. 13, they provide a signal indicating an "absence of printing paper".

Downward shifting of the slide plate 41 is induced by lateral displacement of the actuating plate in the direction of the arrow C. This causes the pair of paper pushers **38*a* to swing, or to move rearwardly from the position indicated by the dotted line shown in FIG. 2 toward the position indicated by the solid line through the openings 35*a* of the rear wall 37. During printing, the paper pushers 38*a*** are maintained in this position until the ejecting operation begins.

Figure 15:
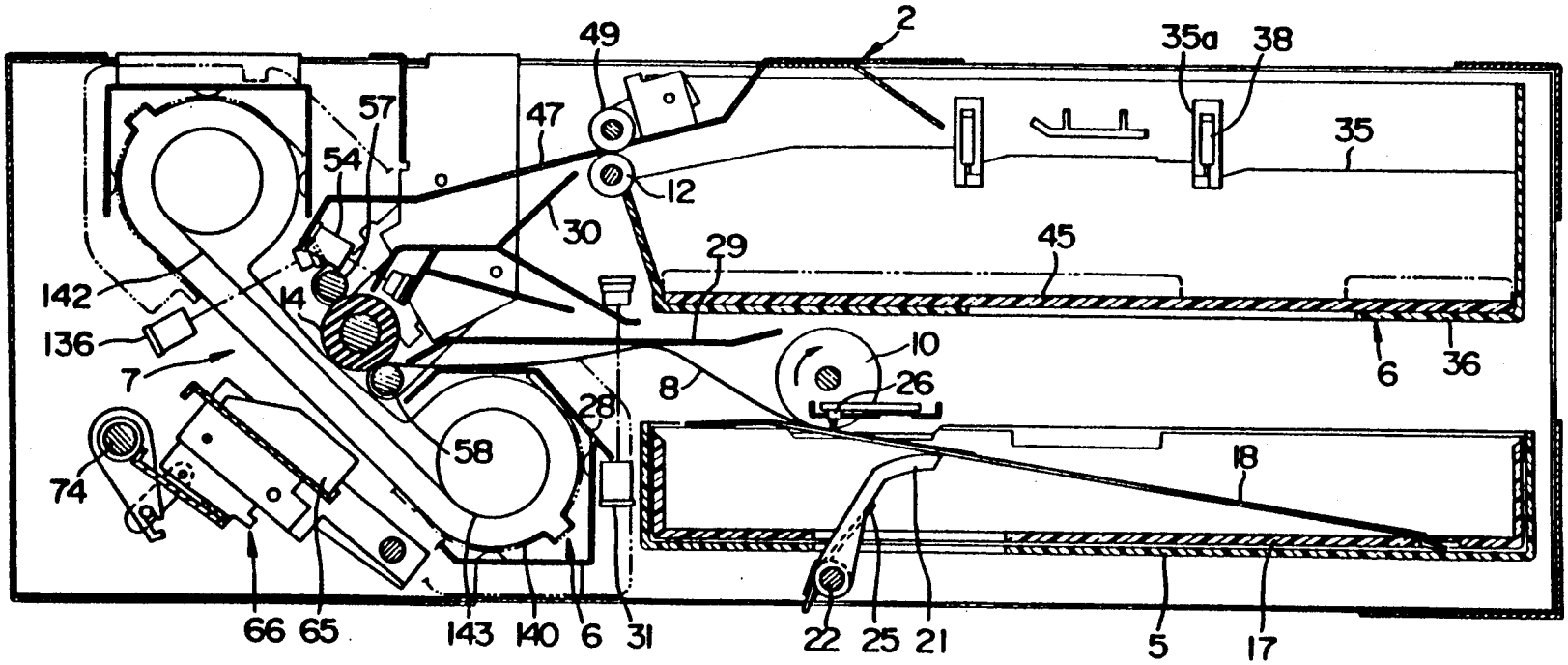
FIG. 15 is an elevational view which illustrate a paper sheet being fed to a platen.
Figure 16:
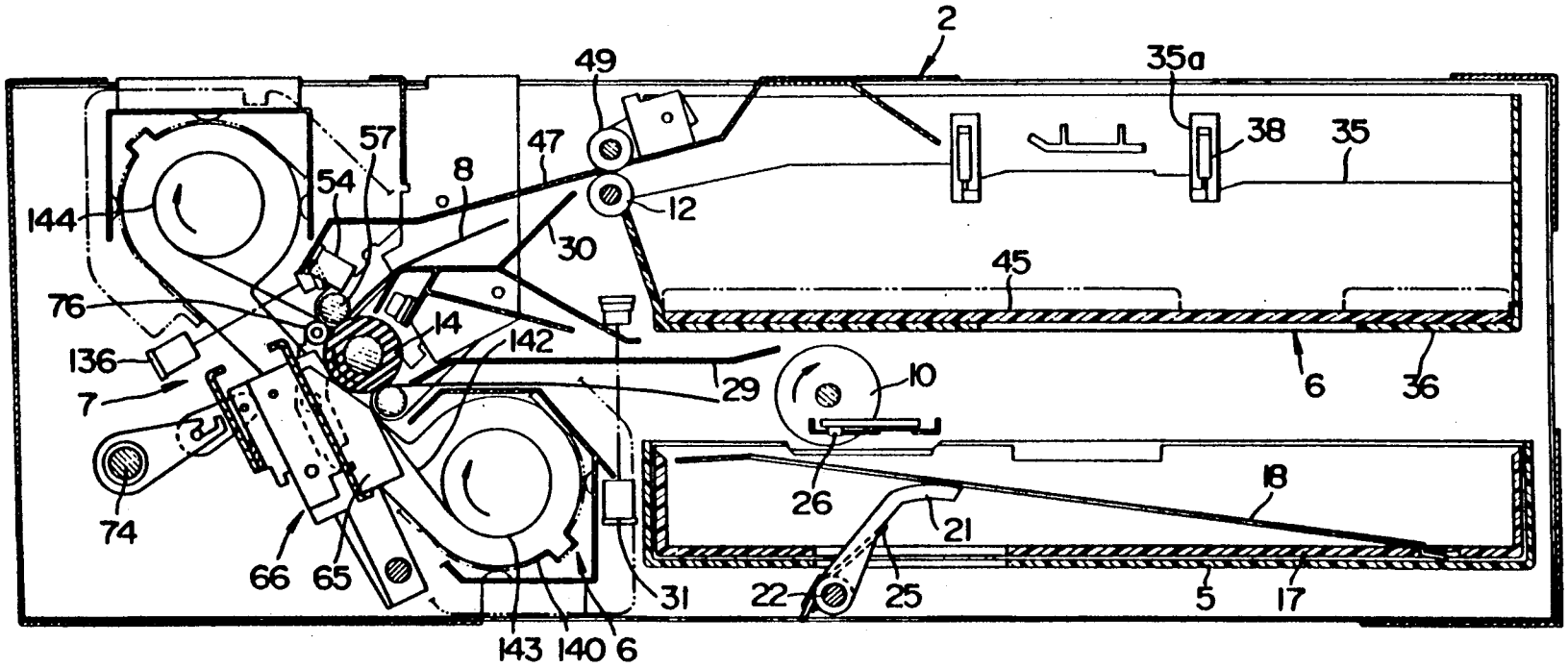
FIG. 16 is a longitudinal sectional view of the printing apparatus of the present invention printing a yellow image on a sheet of paper.
Figure 17:
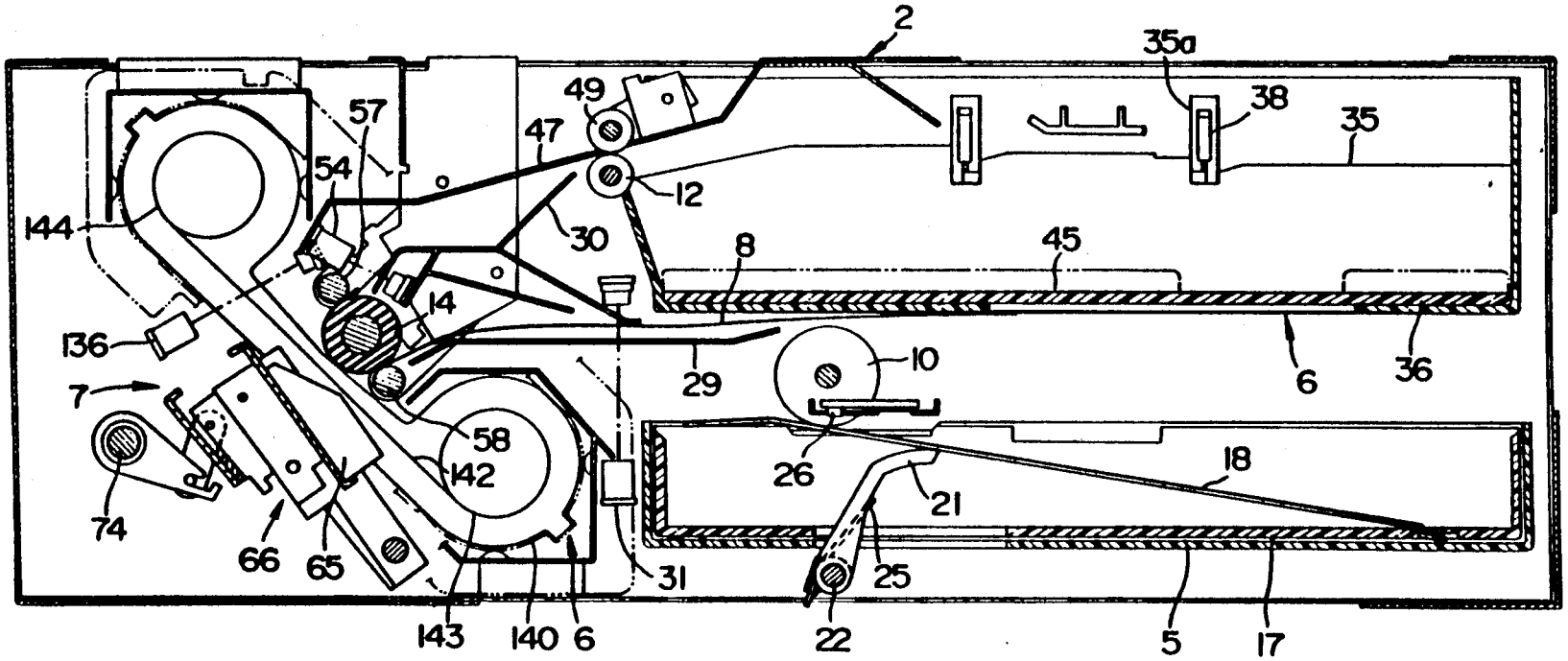
FIG. 17 is a longitudinal sectional view of a printing apparatus of the present invention which illustrates loading of a printed sheet with the yellow image.
Figure 23:
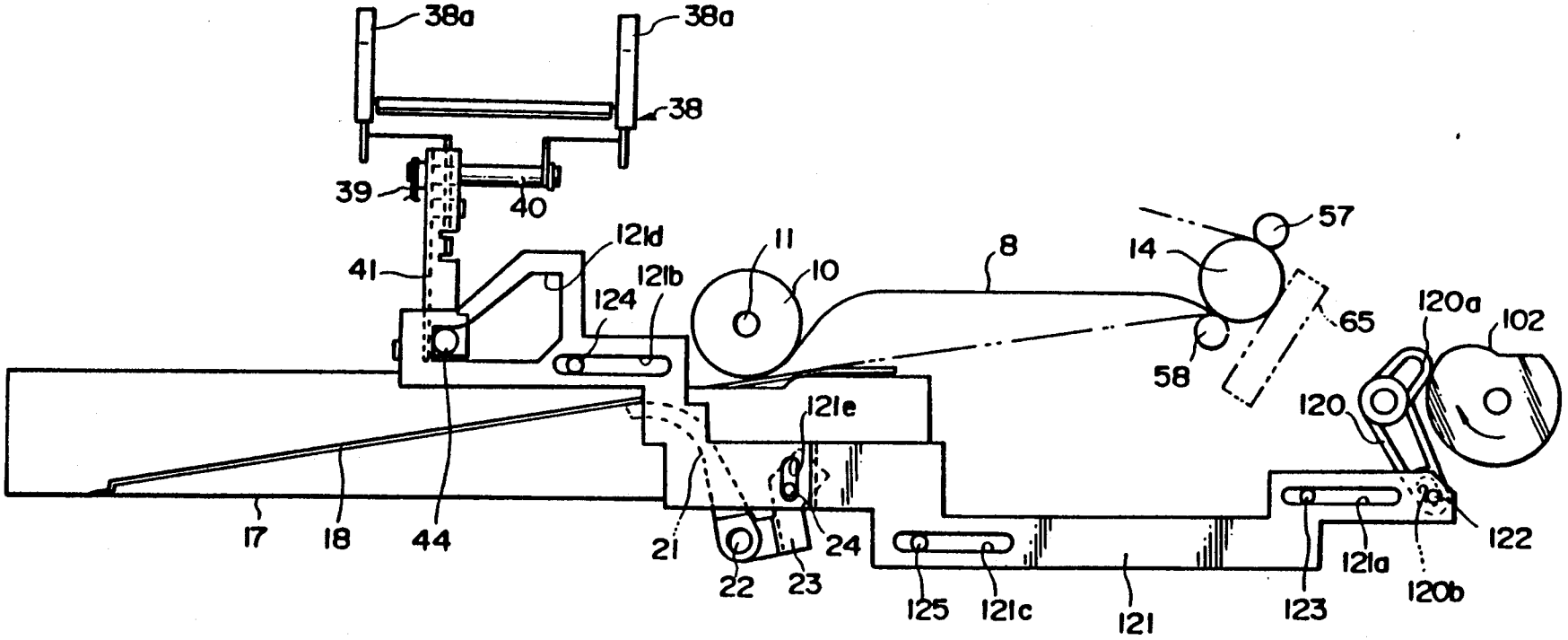
FIG. 23 is an elevational view which illustrates a mechanical relationship between the pair of paper pushers and a feeding lever for the feeding tray when feeding a paper sheet.
Figure 25:
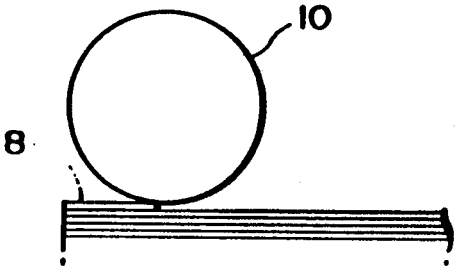
FIG. 25 is an explanatory view which shows a contact between a feeding roller and a sheet of printing paper.
Figure 24:
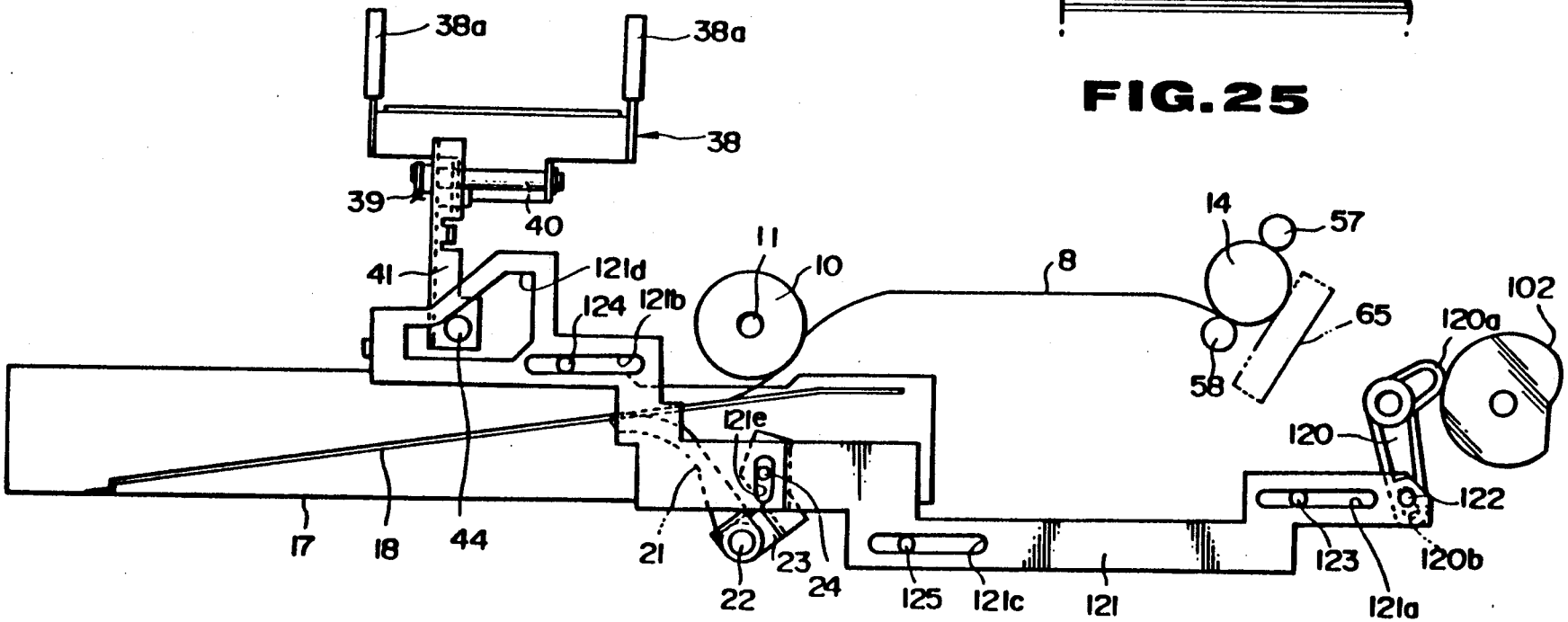
FIG. 24 is an explanatory view which shows a mechanical relationship between a pair of paper pushers and a feeding lever for the feeding tray during printing.

When actuated, the pulse motor 92 causes the driving gear 95 to rotate via the shift gear 90 and the second idler gear 87, thereby rotating the feeding rollers 10 in the direction of an arrow indicated in FIG. 15. Upon rotation of the feeding rollers 10, the printing paper sheet 8 is fed to the printing station 7 through the feeding path defined by the middle and lower paper guiding plates 29 and 28. When the front edge of the printing paper sheet 8 arrives between the platen 14 and the lower side pinch roller 58, the cam 102 of the head cam gear 100 is in the angular position as shown in FIG. 23. At this time, the ratchet lever 83 engages the driving gear 80 to prevent the feeding rollers 10 from rotating in the reverse direction. Therefore, as shown in FIGS. 15 and 23, the printing paper sheet 8 is bent for a moment. The shock from the printing paper sheet 8 leaving the feeding rollers 10 tends to cause a striped image pattern on the printing surface thereof. As mentioned before, it is known that the striped image pattern is caused by the paper sheet shifting. This shifting causes a slight shock due to contact between the next paper sheet and the feeding rollers which is generated after the previous printing paper sheet leaves the feeding rollers as shown in FIG. 25.

In the printing apparatus according to the invention, return of the shift lever 21 occurs slightly before the paper sheet leaves the feeding rollers 10. When the cam follower **120*a* is positioned on the cam surface 102 indicated in FIG. 24, the actuating plate 121 returns slightly backwards toward its initial position. The lever 21 therefore moves slightly downwardly so as to thinly separate the bottom plate 18 within the feeding tray 17 from the feeding rollers 10. In this position, shifting of the printing paper sheet 8** in the printing station is prevented, and as a result thereof, a striped image pattern is not formed.

Further, in the above mechanism, contact between the feeding rollers 10 and the printing paper sheets 8 only occurs during the paper feeding process (i.e. until the front end of the printing paper sheet 8 reaches the platen 14 and the pinch roller 58). Therefore, deformation of the feeding rollers and the shaft 11 is prevented.

Moreover, when the paper sheet 8 leaves the feeding rollers 10, the reaction thereof tends to induce the feeding roller to rotate in the opposite direction. The ratchet lever 83 however meshes with the driving gear 80 for the feeding rollers 10 to prevent the feeding rollers from rotating in the reverse direction. Thus, the rear end of the printing paper sheet is maintained in alignment.

Thereafter, the head moving device 66 lifts the thermal head 65 up toward the platen 14 to push the ink ribbon 142 up against the platen 14. Next, the take up driving reel table 149 is rotated and the leader of the ink ribbon 142 is read by the photosensor 136 so as the align to tape at an initial position. The driving force changing device 130 stops the rotation of the feeding rollers 10 and drives the platen 14 in the direction of an arrow indicated in FIG. 16. The printing paper sheet 8 is guided by the surface of the ink ribbon so as to be inserted between the thermal head 65 and the platen. The printing paper sheet 8 is then propelled to the ribbon roller 76. The ribbon roller 76 guides the paper sheet 8 between the pinch roller 57 and the platen 14 so as to wrap it about the peripheral surface of the platen. When the printing paper sheet 8 passes through a detecting area defined by the paper edge sensor 54, the sensor senses the edge thereof and provides a signal for starting printing to a printing controller (not shown). According to the signal output from the printing controller, the thermal head generates heat to begin printing a yellow image pattern.

Figure 18:
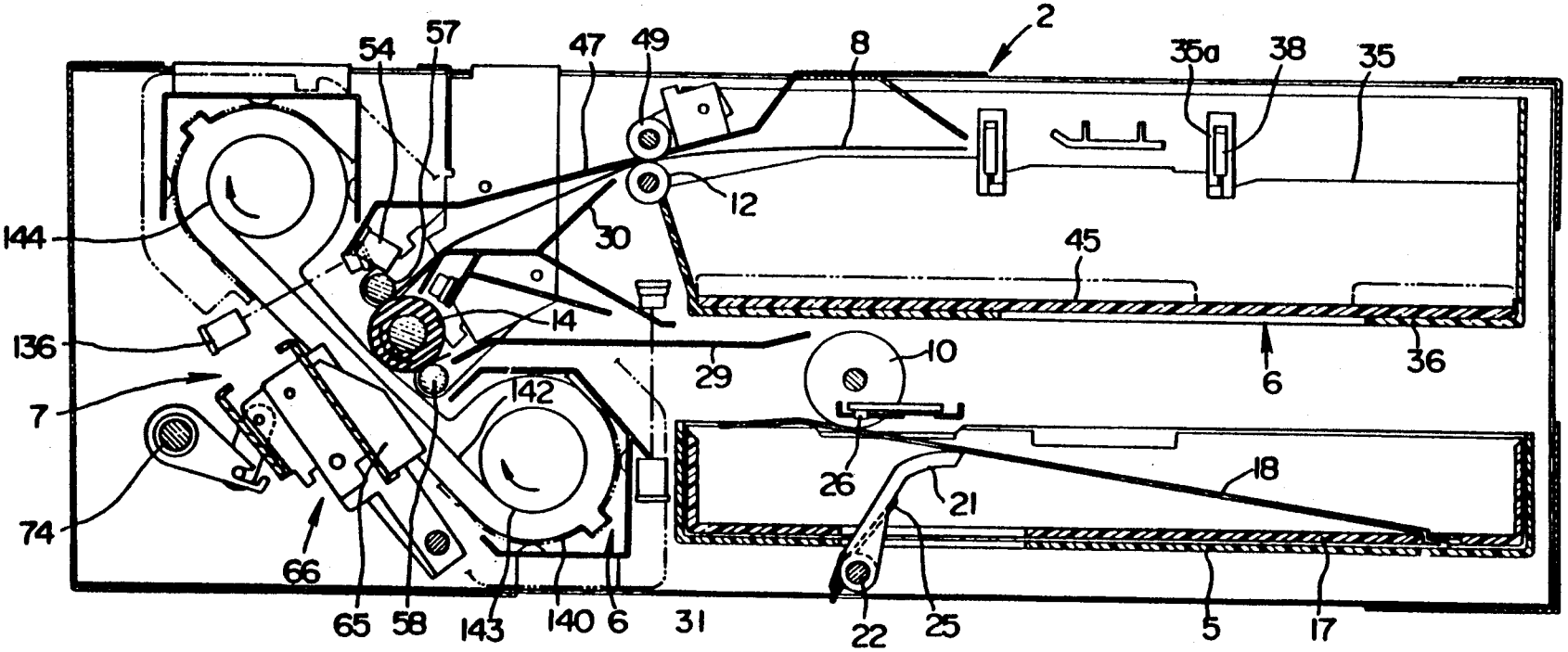
FIG. 18 is a longitudinal sectional view of a printing apparatus of the present invention with the leader of the ink-ribbon being aligned after printing the yellow image.
Figure 19:
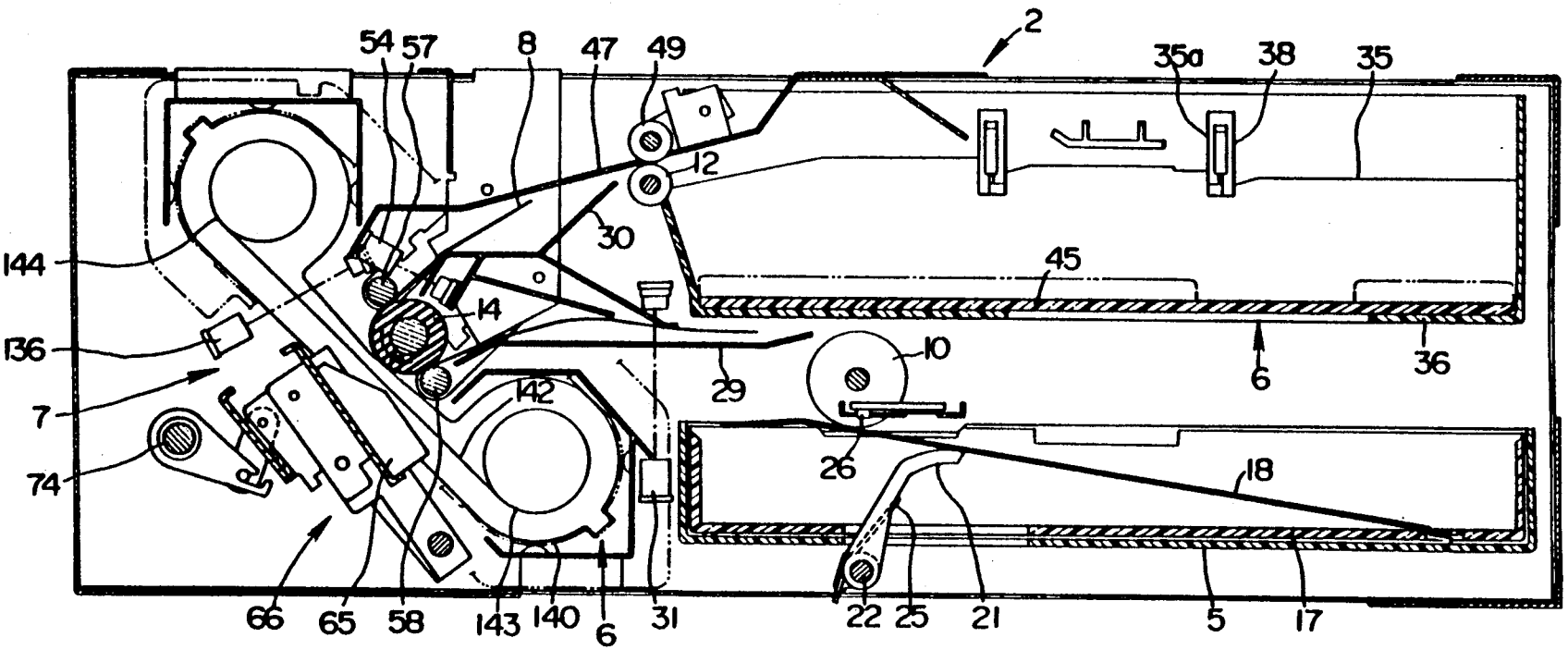
FIG. 19 is a longitudinal sectional view of a printing apparatus of the present invention during the return of the printed sheet.
Figure 20:
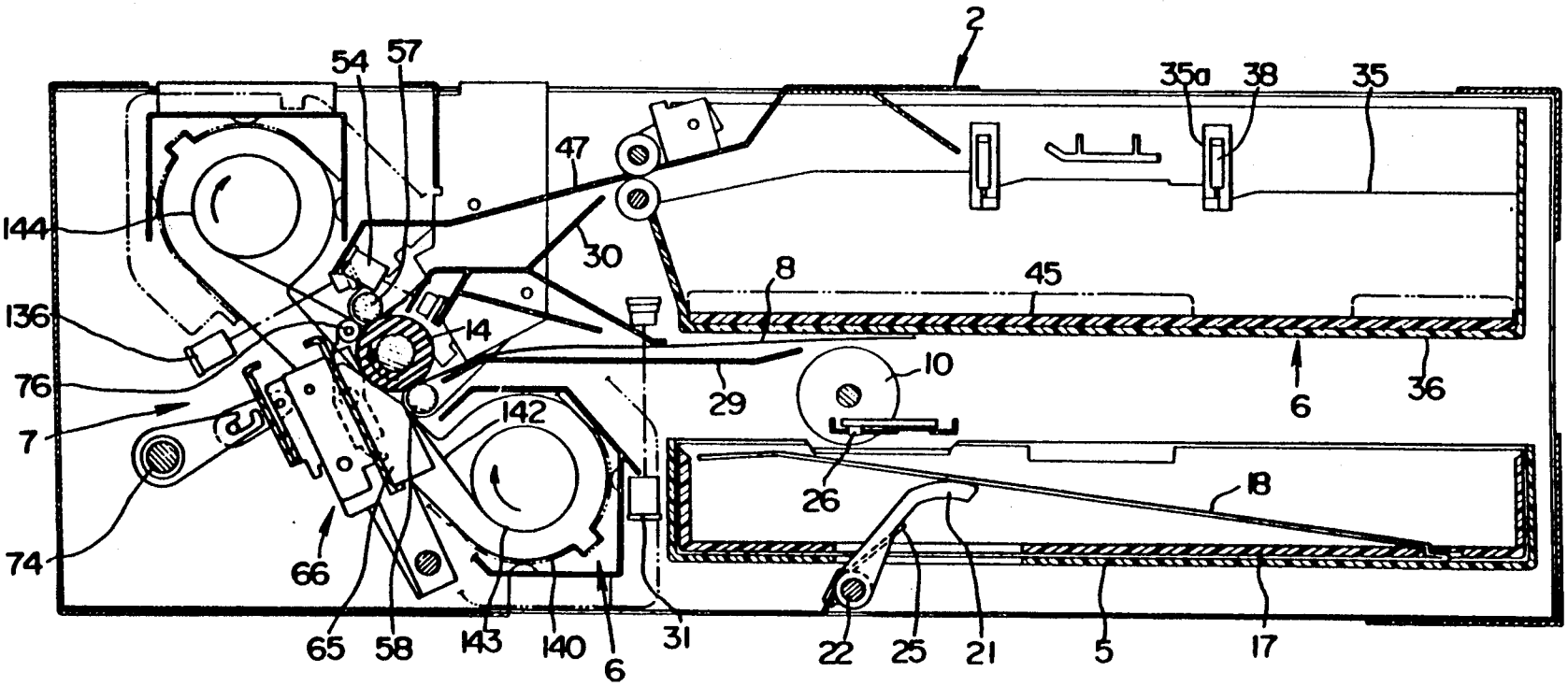
FIG. 20 is a longitudinal sectional view of a printing apparatus of the present invention printing a magenta image.

When the front edge of the printing paper sheet 8 passes through an ejecting passageway defined by the upper paper guiding plate 30 and the upper paper guiding lid plate 47 adjacent to the ejecting rollers 12 and the yellow printing is finished, the rear edge thereof passes beneath a platen side edge of the middle paper guiding plate 29. As shown in FIG. 18, when rear edge thereof leaves the platen side edge of the middle paper guiding plate 29, the rear edge shifts toward the upperside of the middle paper guiding plate due to its rigidity. The rotational direction of the platen 14 is then reversed. The yellow printed paper sheet 8, as shown in FIG. 19, is then fed between the upper paper guiding plate 30 and the middle paper guiding plate 29. At this time, the supply reel table 150 is braked by the brake arm 182 to thereby stop the supply ribbon reel 143. When the front edge of the printing paper sheet 8 passes through the detecting area of the sensor 54 again, the sensor detects it and outputs a signal for reversing the rotational direction of the platen 14 and for starting printing of the magenta (M) color. After finishing the Y color printing, the brake arm 182 is released from the supply reel table 150 and the leader of the M color in the ink ribbon 142 is aligned. Japanese Patent Application (Tokugansho) No. 62-65965 exemplifies such a process for leader alignment of an ink ribbon, and the contents of the disclosure are hereby incorporated by reference. As shown in FIG. 20, the M color image is printed on the printing surface of the printing paper sheet 8 in the same manner as the previous image. After finishing M color printing, a cyanogen (C) color image pattern is printed.

Figure 21:
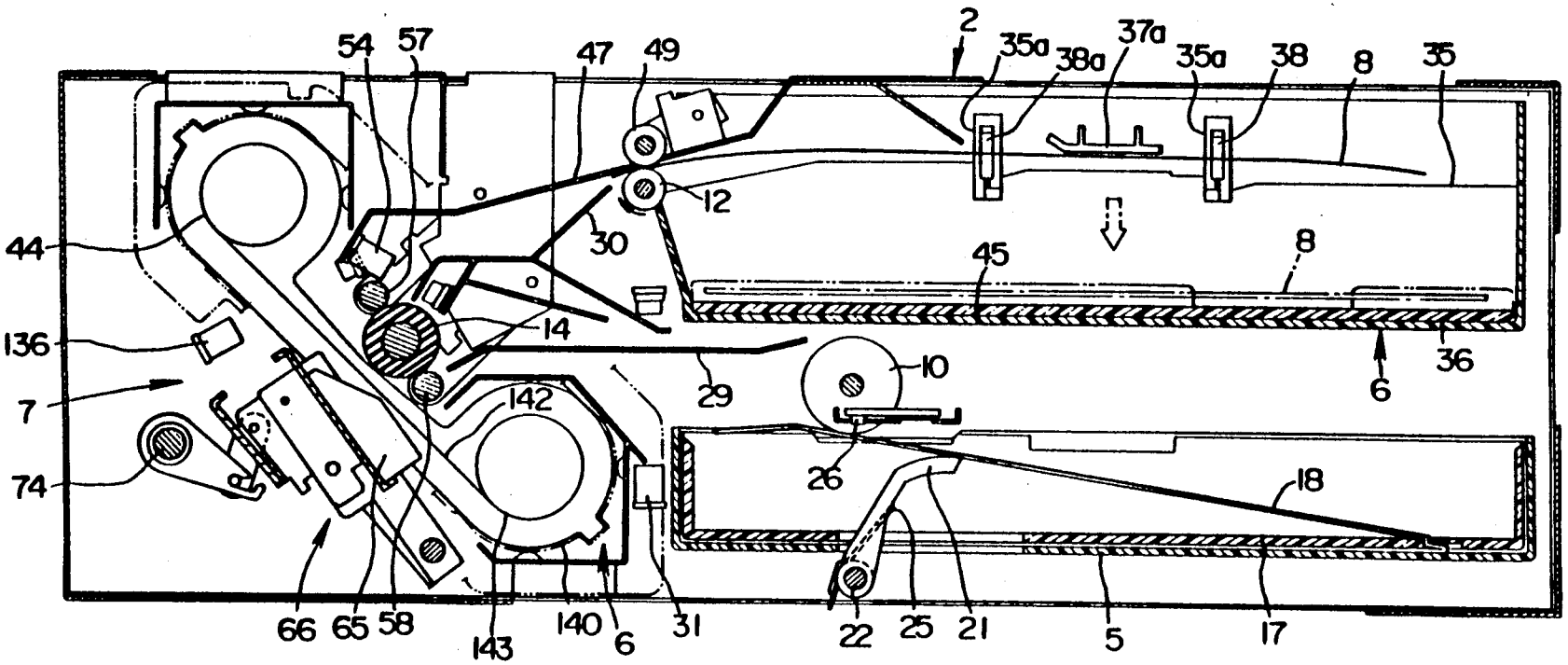
FIG. 21 is a longitudinal sectional view of a printing apparatus of the present invention illustrating the ejecting operation occuring after printing a cyanogen image.

After the C color printing is over, as shown in FIG. 21, the ejecting rollers 12 begin to rotate to carry the printed paper sheet 8 toward the second tray housing 6. The paper sheet 8 is guided onto the upper step 35 by the upper paper guiding lid plate 47, the rear wall 37, and the guiding flange 37*a*. Thereafter, the actuating plate 121 returns to the initial position to swing the pair of paper pushers 38*a* from the openings 35*a*, as indicated by the solid line in FIG. 2. The printed paper sheet on the upper step 35 is ejected forwardly onto the receiving tray 45 on the lower step 36, and thus, completing the printing operation.

As described above, the printing apparatus according to the present invention is adapted for ejects the printed paper sheet 8 onto the receiving tray 45 disposed on the lower step 36 from the upper step 35 by swing force of the pair of paper pushers. Thus, the printed paper sheets can be removed easily from the front of the apparatus without withdrawing the receiving tray 45 from the tray housing 6. This results in greatly improved access to the ejected printed paper sheets.

Although illustrative embodiments of the present invention have been described in detail above with reference to the accompanying drawings, it is to be understood that the invention is not limited to those precise embodiments, and that various changes and modifications can be effected therein by one skilled in the art without departing from the scope or spirit of the invention, as defined by the appended claims. For example, after a plurality of printed paper sheets are stacked on the upper step 35, they may be ejected together.

What is claimed is:

1. A printing apparatus comprising:

a printing mechanism including a printing head and a platen for carrying out a printing operation;

a discharge tray;

a discharge means for transmitting a printed paper sheet from said printing mechanism to said discharge tray, and including shifting means for shifting said printed sheet from an intermediate discharge position to said discharge tray;

a supply mechanism including:

a supply tray for containing a stack of paper sheets, a stack of paper sheets contained in said supply tray, each sheet having leading and trailing edges, a vertically movable bottom plate in said supply tray for raising said stack of paper sheets, and a roller rotatably mounted above said supply tray and being engageable with an uppermost sheet in said stack when the latter is raised by said movable bottom plate for propelling the engaged paper sheet from said supply tray to said platen in a path having a length therealong from said rollers to said platen which is substantially smaller than the dimension of each of said paper sheets between said leading and trailing edges; and control means for controlling movement of said roller and said bottom plate including drive means operative for selective rotation of said roller, and actuating means operative in synchronism with said drive means for raising said bottom plate at the initiation of said selective rotation so that said roller engages said uppermost paper sheet and propels the latter along said path to said platen and for lowering said bottom plate and thereby disengaging said roller from said uppermost paper sheet before said trailing edge of said uppermost paper sheet is propelled past said roller, thereby preventing the imparting of shock to said uppermost paper sheet while a portion thereof is at said platen for the performance of a printing operation;

said actuating means including an actuation member connected to said shifting means and movable between a first position and a second position, movement of said actuation member from said first position to said second position causing the raising of said bottom plate and movement of said actuation member from said second position to said first position causing said shifting means to shift said printed sheet from said intermediate discharge position to said discharge tray.

2. Printing apparatus as set forth in claim 1, wherein said actuating means includes a lever for moving said bottom plate.

3. Printing apparatus as set forth in claim 1, wherein said control means further includes a motor for controlling movements of said printing head.

* * * * *